US009803338B2

(12) United States Patent
Jagoda

(10) Patent No.: US 9,803,338 B2
(45) Date of Patent: Oct. 31, 2017

(54) SYSTEM AND METHOD FOR RECOVERING ENERGY AND LEVELING HYDRAULIC SYSTEM LOADS

(75) Inventor: Aaron Hertzel Jagoda, St. Louis Park, MN (US)

(73) Assignee: Eaton Corporation, Columbus, OH (US)

( * ) Notice: Subject to any disclaimer, the term of this patent is extended or adjusted under 35 U.S.C. 154(b) by 742 days.

(21) Appl. No.: 13/571,517

(22) Filed: Aug. 10, 2012

(65) Prior Publication Data

US 2013/0061587 A1 Mar. 14, 2013

Related U.S. Application Data

(60) Provisional application No. 61/523,099, filed on Aug. 12, 2011.

(51) Int. Cl.

| | |
|---|---|
| ***F15B 1/027*** | (2006.01) |
| ***E02F 9/22*** | (2006.01) |
| ***E02F 9/12*** | (2006.01) |
| ***F15B 1/02*** | (2006.01) |
| ***F15B 3/00*** | (2006.01) |

(52) U.S. Cl.

CPC ..... *E02F 9/2217* (2013.01); *E02F 9/123* (2013.01); *F15B 1/024* (2013.01); *F15B 3/00* (2013.01)

(58) Field of Classification Search

CPC .. F15B 1/024; F15B 1/033; F15B 3/00; F15B 21/14

See application file for complete search history.

(56) References Cited

U.S. PATENT DOCUMENTS

| | | | |
|---|---|---|---|
| 3,113,581 | A | 12/1963 | Presnell |
| 3,892,283 | A | 7/1975 | Johnson |
| 4,026,107 | A | 5/1977 | Kosek et al. |
| 4,068,728 | A | 1/1978 | Subrick |
| 4,108,198 | A | 8/1978 | England |
| 4,261,431 | A | 4/1981 | Hawbaker |
| 4,528,892 | A | 7/1985 | Okabe et al. |

(Continued)

FOREIGN PATENT DOCUMENTS

| | | | |
|---|---|---|---|
| DE | 10 2006 046 127 | A1 | 4/2008 |
| DE | 10 2009 053 702 | A1 | 5/2011 |

(Continued)

OTHER PUBLICATIONS

Partial International Search for PCT/US2012/049962 mailed Nov. 9, 2012.

(Continued)

*Primary Examiner* — Thomas E Lazo
*Assistant Examiner* — Matthew Wiblin
(74) *Attorney, Agent, or Firm* — Merchant & Gould P.C.

(57) ABSTRACT

A hydraulic system including an accumulator and a hydraulic transformer is disclosed. The hydraulic transformer includes first and second variable displacement pump/motor units mounted on a rotatable shaft. The rotatable shaft has an end adapted for connection to an external load. The first variable displacement pump/motor unit includes a first side that fluidly connects to a pump and a second side that fluidly connects to a tank. The second variable displacement pump/motor unit includes a first side that fluidly connects to the accumulator and a second side that fluidly connects with the tank.

23 Claims, 27 Drawing Sheets

(56) References Cited

U.S. PATENT DOCUMENTS

| | | | | |
|---|---|---|---|---|
| 4,553,391 | A | 11/1985 | Reinhardt | |
| 4,586,332 | A | 5/1986 | Schexnayder | |
| 4,693,080 | A | 9/1987 | Van Hooff | |
| 4,707,993 | A | 11/1987 | Kime | |
| 5,285,641 | A | 2/1994 | Goto et al. | |
| 5,381,661 | A | 1/1995 | Malina | |
| 5,794,437 | A | 8/1998 | Lisniansky | |
| 5,794,438 | A | 8/1998 | Lisniansky | |
| 5,794,441 | A | 8/1998 | Lisniansky | |
| 5,852,933 | A | 12/1998 | Schmidt | |
| 5,916,139 | A | 6/1999 | Tieben | |
| 6,005,360 | A | 12/1999 | Pace | |
| 6,009,708 | A | 1/2000 | Miki et al. | |
| 6,125,828 | A | 10/2000 | Hu | |
| 6,223,529 | B1 | 5/2001 | Achten | |
| 6,370,873 | B1 | 4/2002 | Schaich et al. | |
| 6,378,301 | B2 | 4/2002 | Endo et al. | |
| 6,438,951 | B2 | 8/2002 | Morgan | |
| 6,460,332 | B1 | 10/2002 | Maruta et al. | |
| 6,497,558 | B1 | 12/2002 | Hale | |
| 6,575,076 | B1 | 6/2003 | Achten | |
| 6,725,581 | B2 | 4/2004 | Naruse et al. | |
| 6,854,268 | B2 | 2/2005 | Fales et al. | |
| 6,857,441 | B2 | 2/2005 | Flavelle | |
| 6,887,045 | B2 | 5/2005 | Schaeffer | |
| 7,086,226 | B2 | 8/2006 | Oguri | |
| 7,201,095 | B2 | 4/2007 | Hughey | |
| 7,234,298 | B2 | 6/2007 | Brinkman et al. | |
| 7,775,040 | B2 | 8/2010 | Khalil | |
| 7,908,852 | B2 | 3/2011 | Zhang et al. | |
| 2001/0035011 | A1 | 11/2001 | Endo et al. | |
| 2002/0104313 | A1 | 8/2002 | Clarke | |
| 2003/0110766 | A1 | 6/2003 | Berlinger et al. | |
| 2003/0221339 | A1* | 12/2003 | Naruse et al. | 37/348 |
| 2004/0060430 | A1 | 4/2004 | Brinkman | |
| 2004/0107699 | A1 | 6/2004 | Fales et al. | |
| 2005/0279088 | A1 | 12/2005 | Kim | |
| 2006/0051223 | A1 | 3/2006 | Mark et al. | |
| 2007/0049439 | A1 | 3/2007 | Garnett | |
| 2008/0104955 | A1 | 5/2008 | Khalil | |
| 2009/0100830 | A1* | 4/2009 | Schneider et al. | 60/413 |
| 2009/0178399 | A1 | 7/2009 | Bishop | |
| 2009/0241534 | A1 | 10/2009 | Tikkanen et al. | |
| 2010/0236232 | A1 | 9/2010 | Boehm et al. | |
| 2013/0061588 | A1 | 3/2013 | Jagoda | |
| 2014/0166114 | A1 | 6/2014 | Wang et al. | |

FOREIGN PATENT DOCUMENTS

| | | | | |
|---|---|---|---|---|
| EP | 1 433 648 | A2 | 6/2004 | |
| JP | 2004-28212 | | 1/2004 | |
| JP | 2004-28212 | A | 1/2004 | |
| JP | 2004028212 | A * | 1/2004 | F15B 21/14 |
| WO | WO 03/058034 | A1 | 7/2003 | |
| WO | WO 2006/083163 | A1 | 8/2006 | |
| WO | WO 2006/094990 | A1 | 9/2006 | |
| WO | WO 2013/025459 | A1 | 2/2013 | |

OTHER PUBLICATIONS

International Search Report and Written Opinion for PCT/US2012/049962 mailed Feb. 19, 2013.

Series 90 Axial Piston Motors, Technical Information, Sauer Danfoss, 44 pages (Sep. 2008).

The Hydrid: A Hydraulic Series Hybrid, Innas, 8 pages (Publicly known at least as early as Jul. 28, 2011).

International Search Report and Written Opinion mailed Oct. 26, 2012.

* cited by examiner

SYSTEM AND METHOD FOR RECOVERING ENERGY AND LEVELING HYDRAULIC SYSTEM LOADS

CROSS REFERENCE TO RELATED APPLICATIONS

The present application claims the benefit of U.S. Provisional Patent Application Ser. No. 61/523,099, entitled System and Method for Recovering Energy and Leveling Hydraulic System Loads, and filed on Aug. 12, 2011, the disclosure of which is hereby incorporated by reference in its entirety.

BACKGROUND

Mobile pieces of machinery (e.g., excavators) often include hydraulic systems having hydraulically powered linear and rotary actuators used to power various active machine components (e.g., linkages, tracks, rotating joints, etc.). Typically, the linear actuators include hydraulic cylinders and the rotary actuators include hydraulic motors. By accessing a user interface of a machine control system, a machine operator can control movement of the various machine components.

A typical piece of mobile machinery includes a prime mover (e.g., a diesel engine, spark ignition engine, electric motor, etc.) that functions as an overall source of power for the piece of mobile machinery. Commonly, the prime mover powers one or more hydraulic pumps that provide pressurized hydraulic fluid for driving the active machine components of the piece of machinery. The prime mover is typically required to be sized to satisfy a peak power requirement of the system. Because the prime mover is designed to satisfy peak power requirements, the prime mover often does not operate at peak efficiency under average working loads.

The operation of the active hydraulic components of the type described above can be characterized by frequent accelerations and decelerations (e.g., overrunning hydraulic loads). Due to throttling, there is often substantial energy loss associated with decelerations. There is a need for improved systems for recovering energy losses associated with such decelerations.

SUMMARY

One aspect of the present disclosure relates to systems and methods for effectively recovering and utilizing energy from overrunning hydraulic loads.

Another aspect of the present disclosure relates to systems and methods for leveling the load on a hydraulic systems prime mover by efficiently storing energy during periods of low loading and efficiently releasing stored energy during periods of high loading, thus allowing the prime mover to be sized for average power requirement rather than for a peak power requirement. Such systems and methods also permit the prime mover to be run at a more consistent operating condition which allows an operating efficiency of the prime mover to be optimized.

A further aspect of the present disclosure relates to a hydraulic system including a hydraulic transformer capable of providing shaft work against an external load. In certain embodiments, a clutch can be used to engage and disengage the output shaft from the external load such that the unit can also function as a stand-alone hydraulic transformer.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to aspects of the present disclosure that are illustrated in the accompanying drawings. Wherever possible, the same reference numbers will be used throughout the drawings to refer to the same or like structure.

Figure 1:
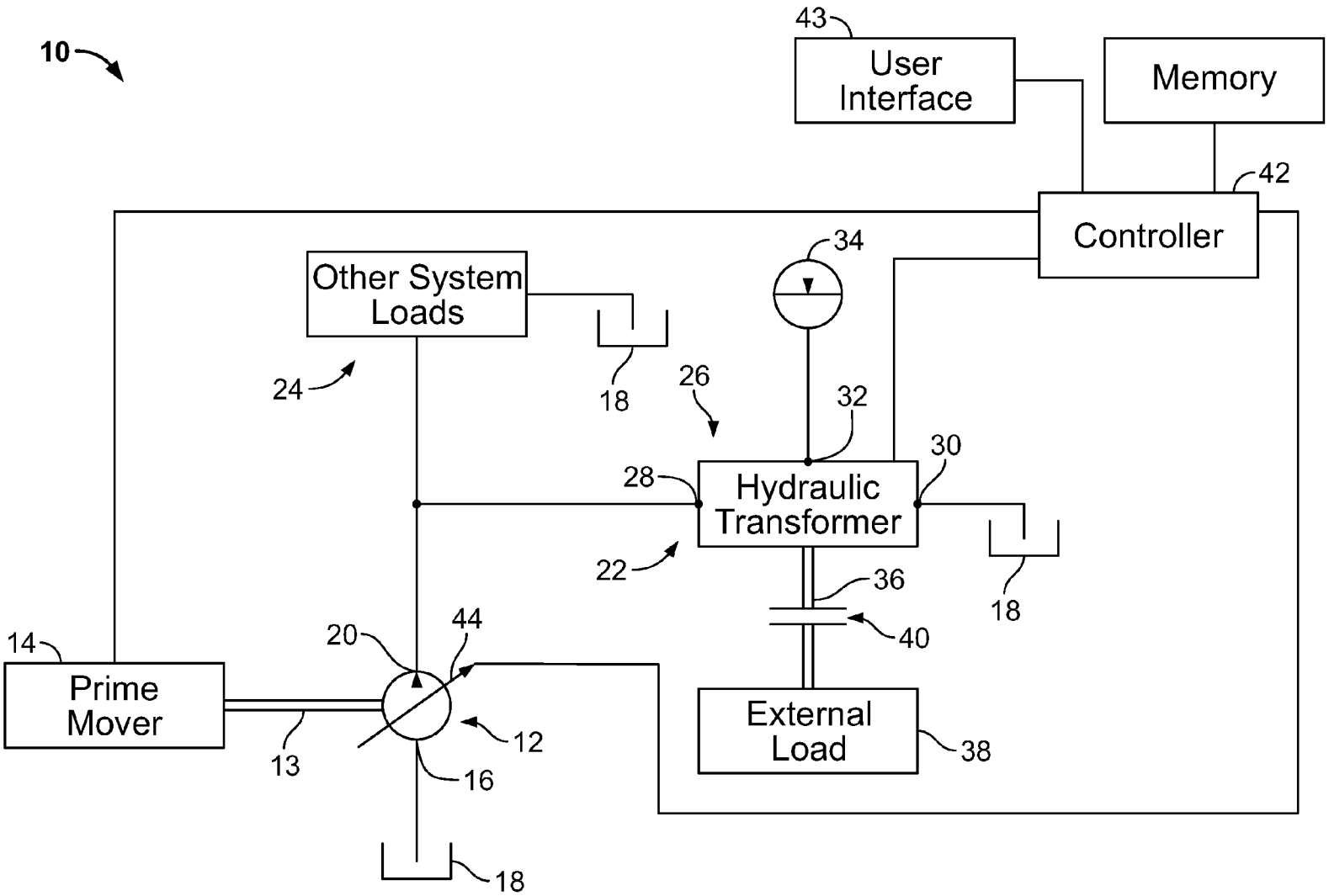
FIG. 1 is a schematic diagram of a first hydraulic system in accordance with the principles of the present disclosure.

FIG. 1 shows a system 10 in accordance with the principles of the present disclosure. The system 10 includes a variable displacement pump 12 driven by a prime mover 14 (e.g., a diesel engine, a spark ignition engine, an electric motor or other power source). The variable displacement pump 12 includes an inlet 16 that draws low pressure hydraulic fluid from a tank 18 (i.e., a low pressure reservoir). The variable displacement pump 12 also includes an outlet 20 through which high pressure hydraulic fluid is output. The outlet 20 is preferably fluidly coupled to a plurality of different working load circuits. For example, the outlet 20 is shown coupled to a first load circuit 22 and a second load circuit 24. The first load circuit 22 includes a hydraulic transformer 26 including a first port 28, a second port 30 and a third port 32. The first port 28 of the hydraulic transformer 26 is fluidly connected to the outlet 20 of the variable displacement pump 12 and is also fluidly connected to the second load circuit 24. The second port 30 is fluidly connected to the tank 18. The third port 32 is fluidly connected to a hydraulic pressure accumulator 34. The hydraulic transformer 26 further includes an output/input shaft 36 that couples to an external load 38. A clutch 40 can be used to selectively engage the output/input shaft 36 with the external load 38 and disengage the output/input shaft 36 from the external load 38. When the clutch 40 engages the output/input shaft 36 with the external load 38, torque is transferred between the output/input shaft 36 and the external load 38. In contrast, when the clutch 40 disengages the output/input shaft 36 from the external load 38, no torque is transferred between the output/input shaft 36 and the external load 38. Gear reductions can be provided between the clutch 40 and the external load 38.

The system 10 further includes an electronic controller 42 that interfaces with the prime mover 14, the variable displacement pump 12, and the hydraulic transformer 26. It will be appreciated that the electronic controller 42 can also interface with various other sensors and other data sources provided throughout the system 10. For example, the electronic controller 42 can interface with pressure sensors incorporated into the system 10 for measuring the hydraulic pressure in the accumulator 34, the hydraulic pressure provided by the variable displacement pump 12 to the first and second load circuits 22, 24, the pressures at the pump and tank sides of the hydraulic transformer 26 and other pressures. Moreover, the controller 42 can interface with a rotational speed sensor that senses a speed of rotation of the output/input shaft 36. Additionally, the electronic controller 42 can be used to monitor a load on the prime mover 14 and can control the hydraulic fluid flow rate across the variable displacement pump 12 at a given rotational speed of a drive shaft 13 powered by the prime mover 14. In one embodiment, the hydraulic fluid displacement across the variable displacement pump 12 per shaft rotation can be altered by changing the position of a swashplate 44 of the variable displacement pump 12. The controller 42 can also interface with the clutch 40 for allowing an operator to selectively engage and disengage the output/input shaft 36 of the transformer 26 with respect to the external load 38.

The electronic controller 42 can control operation of the hydraulic transformer 26 so as to provide a load leveling function that permits the prime mover 14 to be run at a consistent operating condition (i.e., a steady operating condition) thereby assisting in enhancing an overall efficiency of the prime mover 14. The load leveling function can be provided by efficiently storing energy in the accumulator 34 during periods of low loading on the prime mover 14, and efficiently releasing the stored energy during periods of high loading of the prime mover 14. This allows the prime mover 14 to be sized for an average power requirement rather than a peak power requirement.

Figure 2:
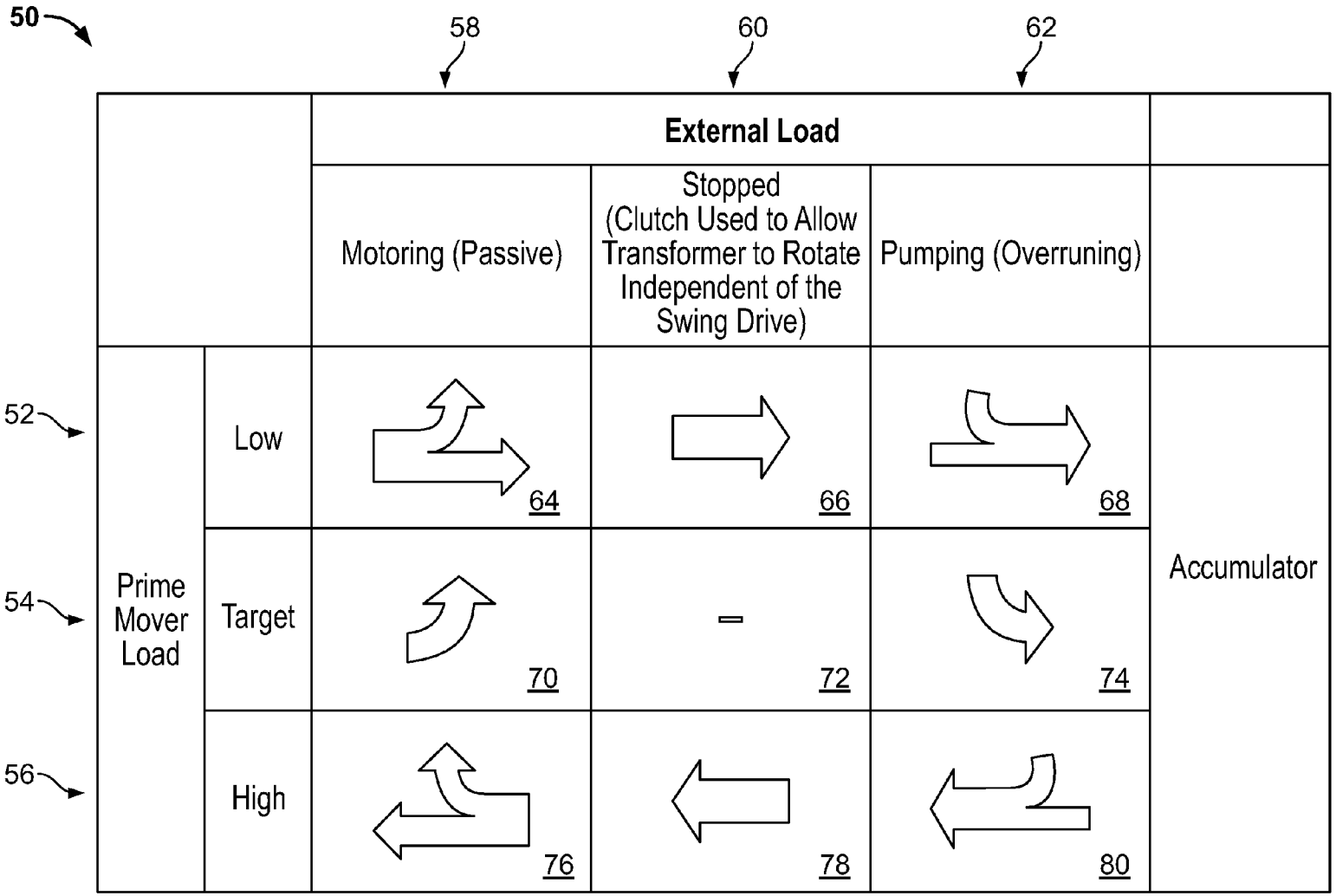
FIG. 2 is a matrix table that schematically depicts various operating modes in which the first hydraulic system of FIG. 1 can operate.

FIG. 2 illustrates a matrix table 50 that schematically depicts an overview of control logic that can be utilized by the electronic controller 42 in controlling the operation of the system 10. It will be appreciated that the matrix table 50 is a simplification and does not take into consideration certain factors such as the state of charge of the accumulator 34. A primary goal of the control logic/architecture is to maintain a generally level loading on the prime mover 14, thus allowing for more efficient operation of the prime mover 14. The control logic/architecture also can reduce the system peak power requirement thereby allowing a smaller prime mover to be used. This is accomplished by using the accumulator 34 and transformer 26 to recover energy from a first working circuit powered by the prime mover 14, and to use the recovered energy as a power supplement for powering a second working circuit powered by the prime mover 14. The accumulator 34 and the transformer 26 can also be used to buffer the energy produced by the prime mover 14. The accumulator 34 and the transformer 26 can further be used to recover energy associated with load decelerations in a way that can eliminate hydraulic throttling.

Referring to FIG. 2, the matrix table 50 includes a plurality of horizontal rows and a plurality of vertical columns. For example, the horizontal rows include a first row 52 corresponding to a low loading condition of the prime mover 14, a second row 54 corresponding to a target loading condition of the prime mover 14, and a third row 56 corresponding to a high loading condition of the prime mover 14. The vertical columns include a first column 58, a second column 60, and a third column 62. The first column 58 represents a condition where the transformer 26 is providing a motoring function where torque is being transferred from the output/input shaft 36 to the external load 38 through the clutch 40. The second column 60 represents a condition where the output/input shaft 36 is decoupled from the external load 38 by the clutch 40. The third column 62 represents a condition where the transformer 26 is providing a pumping function where torque is being transferred from the external load 38 back through the output/input shaft 36.

Figure 3:
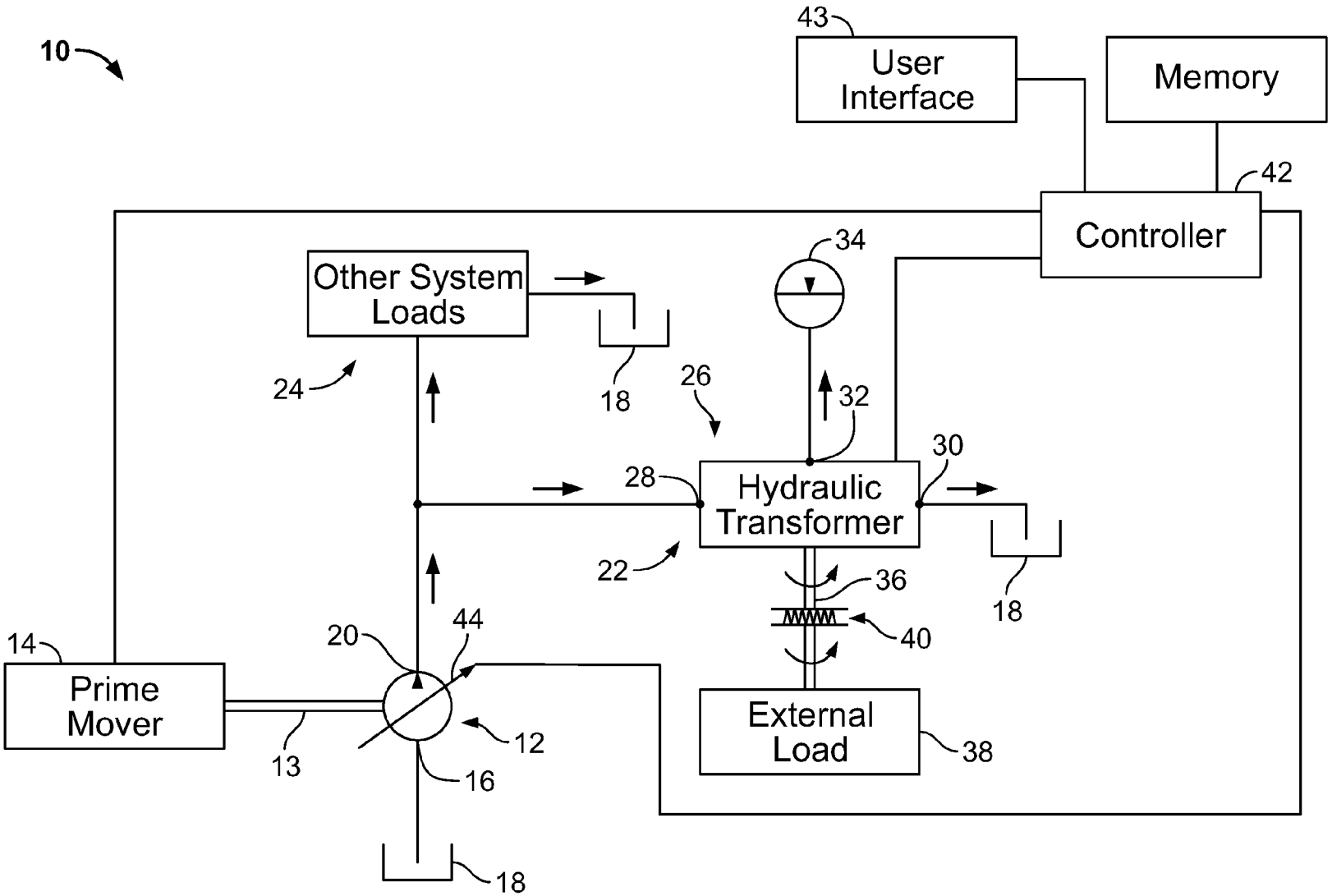
FIGS. 3-11 show the first hydraulic system of FIG. 1 operating in the various operating modes outlined in the matrix table of FIG. 2.

Box 64 of the matrix table 50 represents an operating state/mode where the prime mover 14 is under a low load and the hydraulic transformer 26 is providing a motoring function in which torque is being transferred to the external load 38 through the output/input shaft 36. The system 10 operates in this mode when the electronic controller 42 receives a command from an operator interface 43 (e.g., a control panel, joy stick, toggle, switch, control lever, etc.) instructing the electronic controller 42 to accelerate or otherwise drive the external load 38 through rotation of the output/input shaft 36. In this mode/state, the controller 42 controls operation of the hydraulic transformer 26 such that some hydraulic fluid pressure from the variable displacement pump 12 is used to drive the output/input shaft 36 and the remainder of the hydraulic fluid pressure from the variable displacement pump 12 is used to charge the accumulator 34 (see FIG. 3).

Figure 4:
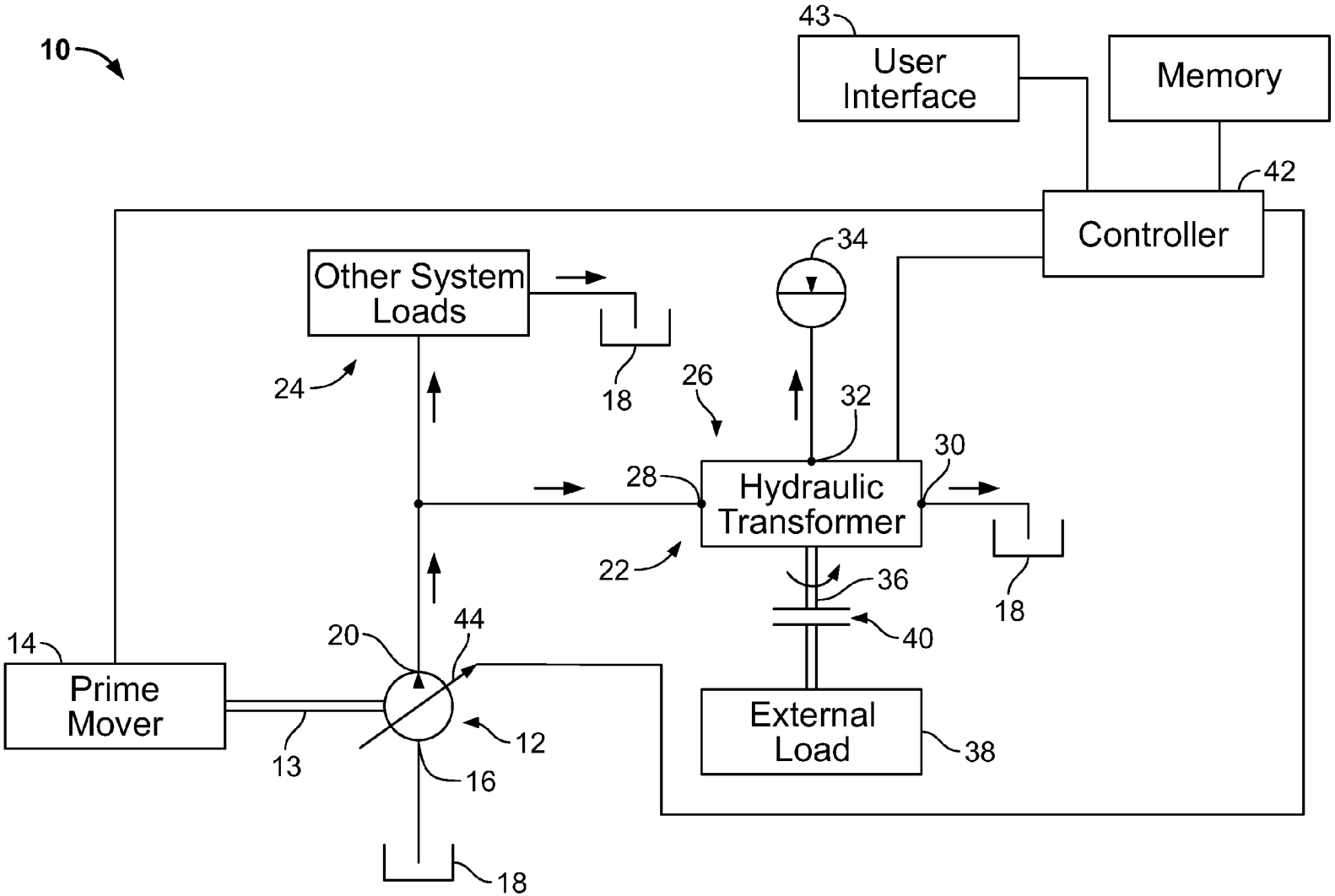

Box 66 of the matrix table 50 represents an operating mode/state where the prime mover 14 is operating under a low load and the output/input shaft 36 is disengaged from the external load 38. In this mode/state, the controller 42 controls operation of the hydraulic transformer 26 such that the transformer 26 functions as a stand-alone transformer in which all excess hydraulic fluid pressure from the variable displacement pump 12 (e.g., excess power not needed by the second working circuit 24) is used to charge the accumulator 34 (see FIG. 4). In this way, the transformer 26 and the accumulator 34 provide an energy buffering function in which otherwise unused energy from the prime mover 14 is stored for later use.

Figure 5:
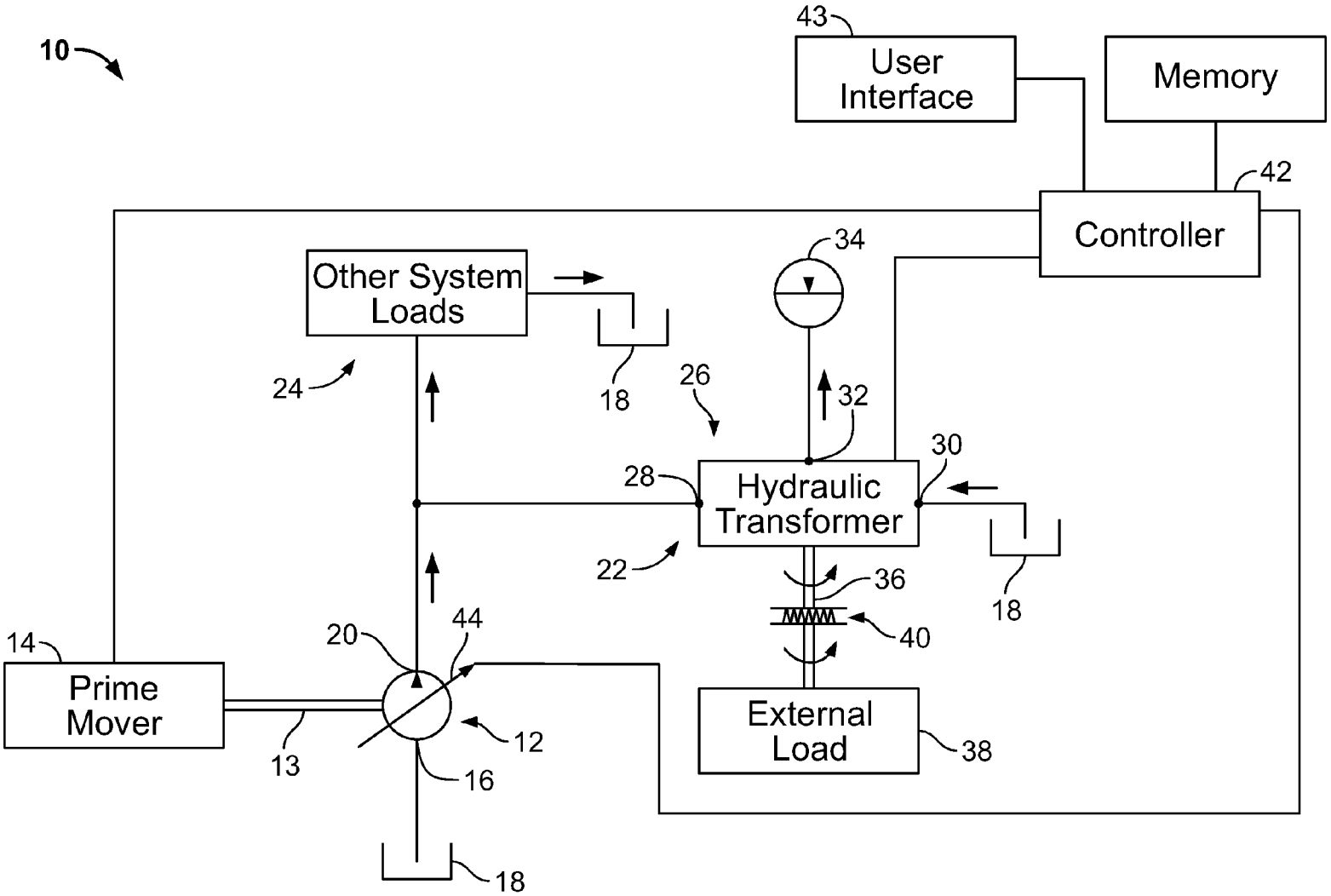

Box 68 of the matrix table 50 represents an operating mode/state where the prime mover 14 is under a low load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this condition, the electronic controller 42 controls the transformer 26 such that the transformer 26 provides a pumping function that converts the torque derived from the inertial energy of the external load 38 into hydraulic energy which is used to charge the accumulator 34 (see FIG. 5). As energy is transferred to the accumulator 34, the transformer 26 functions to brake rotation of the output/input shaft 36 to achieve the desired deceleration. In this mode/state, the electronic controller 42 can also control the transformer 26 such that excess energy from the variable displacement pump 12 is concurrently used to charge the accumulator 34.

Figure 6:
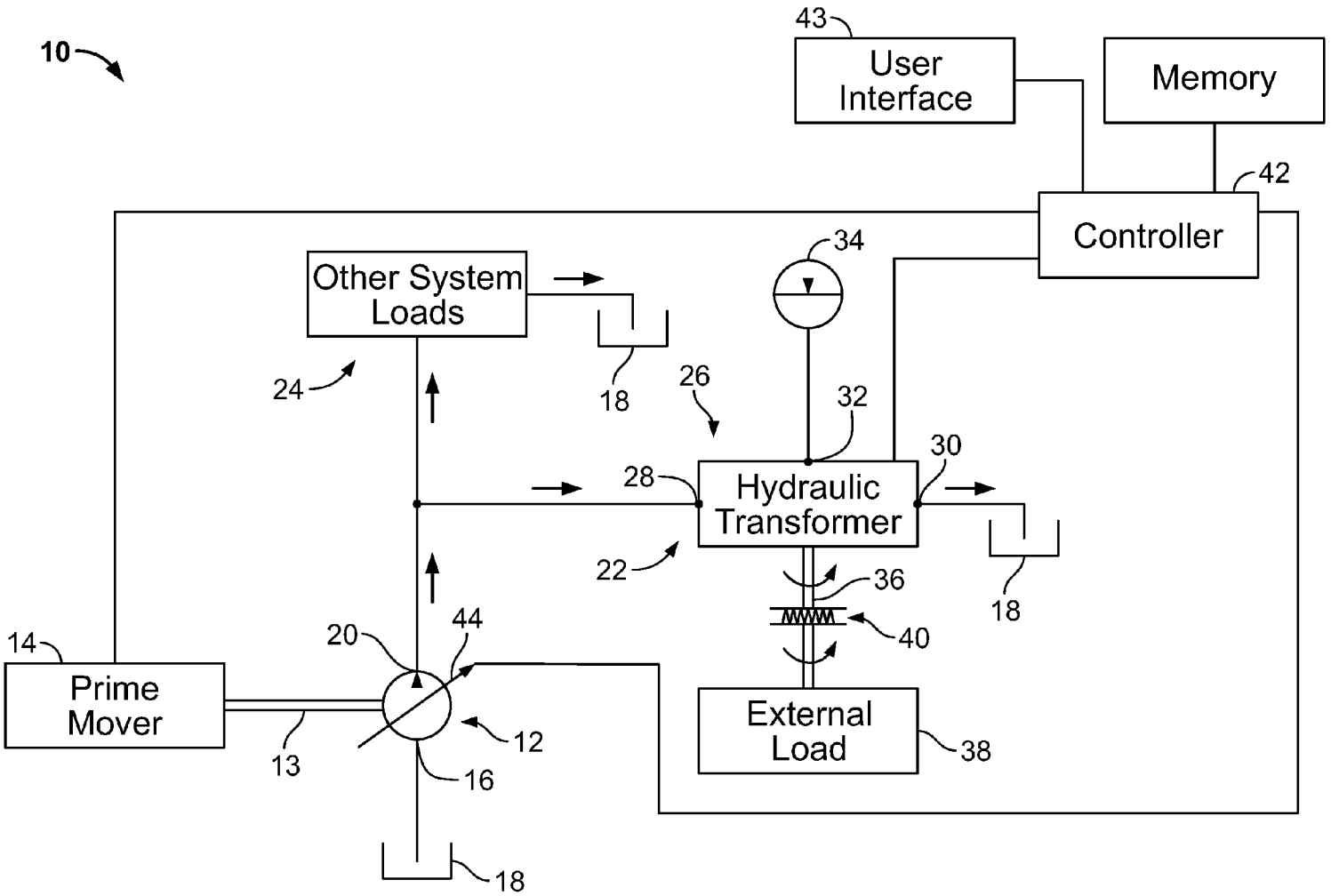

Box 70 of the matrix table 50 represents a mode/state where the prime mover 14 is operating at a target load and the hydraulic transformer 26 is providing a motoring function in which the output/input shaft 36 drives the external load 38. In this mode/state, the electronic controller 42 controls the transformer 26 such that energy from the variable displacement pump 12 is used to drive the output/input shaft 36 and no energy is transferred to the accumulator 34 (see FIG. 6).

Figure 7:
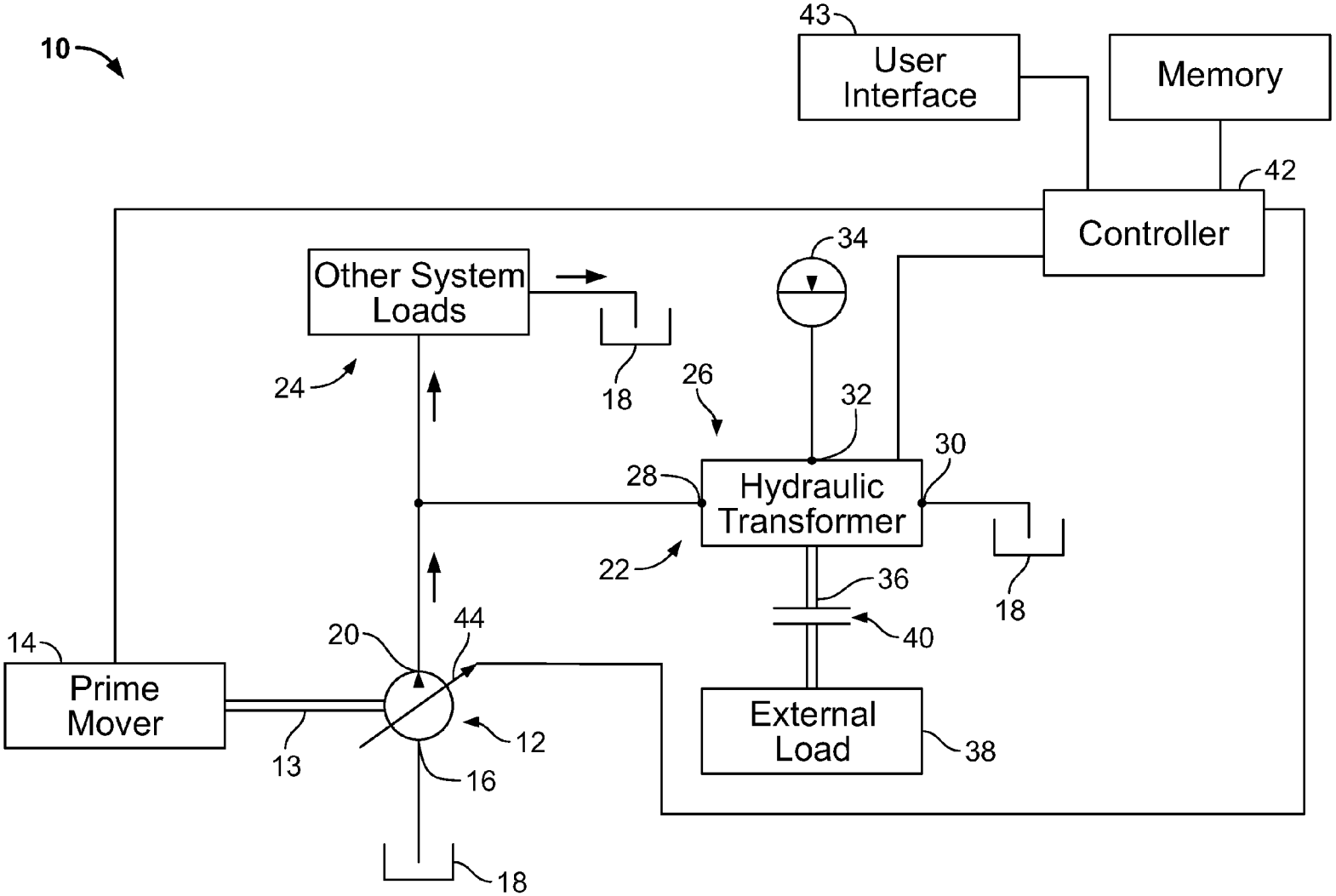

Box 72 represents a mode/state where the prime mover 14 is at a target load and the output/input shaft 36 is disengaged from the external load 38. In this mode/state, the electronic controller 42 controls the transformer 26 such that no energy is transferred through the hydraulic transformer 26 (see FIG. 7).

Figure 8:
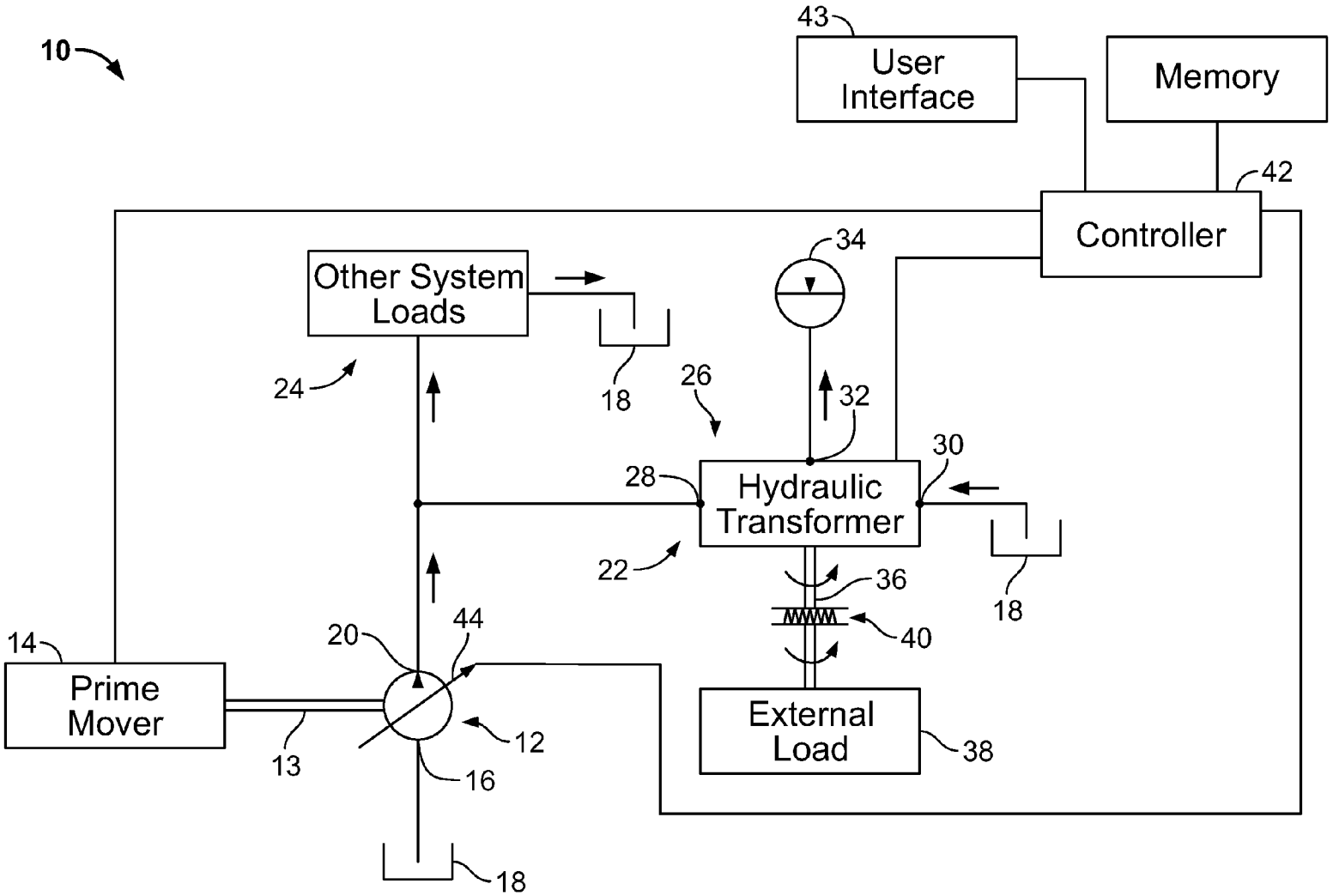

Box 74 of the matrix table 50 is representative of a mode/state where the prime mover 14 is at a target load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this mode/state, the electronic controller 42 controls the transformer 26 such that the transformer 26 provides a pumping function that converts the torque derived from the inertial energy of the external load 38 into hydraulic energy which is used to charge the accumulator 34 (see FIG. 8). As energy is transferred to the accumulator 34, the transformer 26 functions to brake rotation of the output/input shaft 36 to achieve the desired deceleration.

Figure 9:
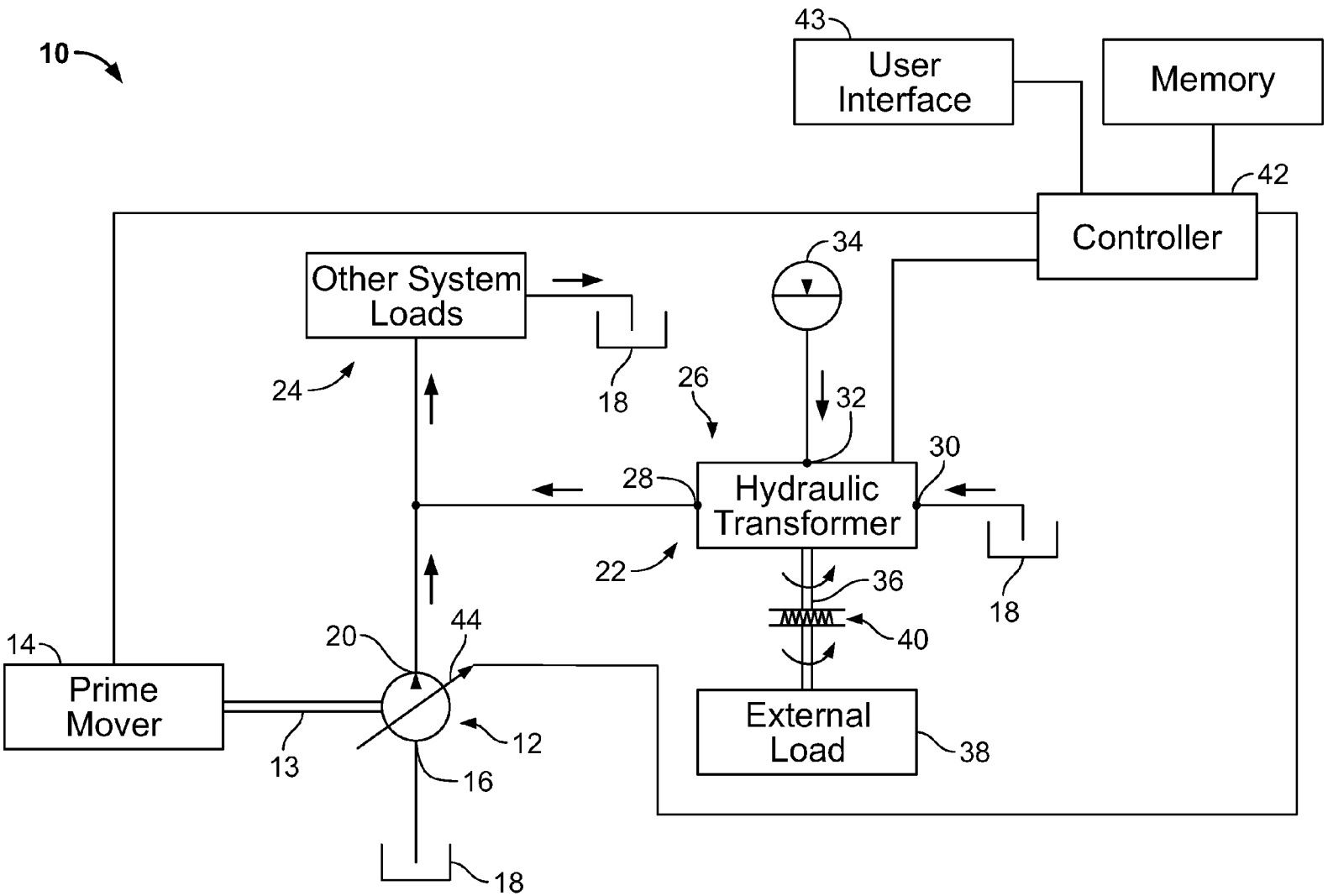

Box 76 of the matrix table 50 is representative of an operating mode/state where the prime mover 14 is operating under a high load and the transformer 26 provides motoring function in which the output/input shaft 36 drives the external load 38. In this mode/state, the controller 42 controls the transformer 26 such that energy from the accumulator 34 is used to rotate the output/input shaft 36 for driving the external load 38. Also, the transformer 26 is controlled by the controller 42 such that excess energy from the accumulator 34 can be concurrently transferred back toward the variable displacement pump 12 and the second load circuit 24 (see FIG. 9) to assist in leveling/reducing the load on the prime mover 14.

Figure 10:
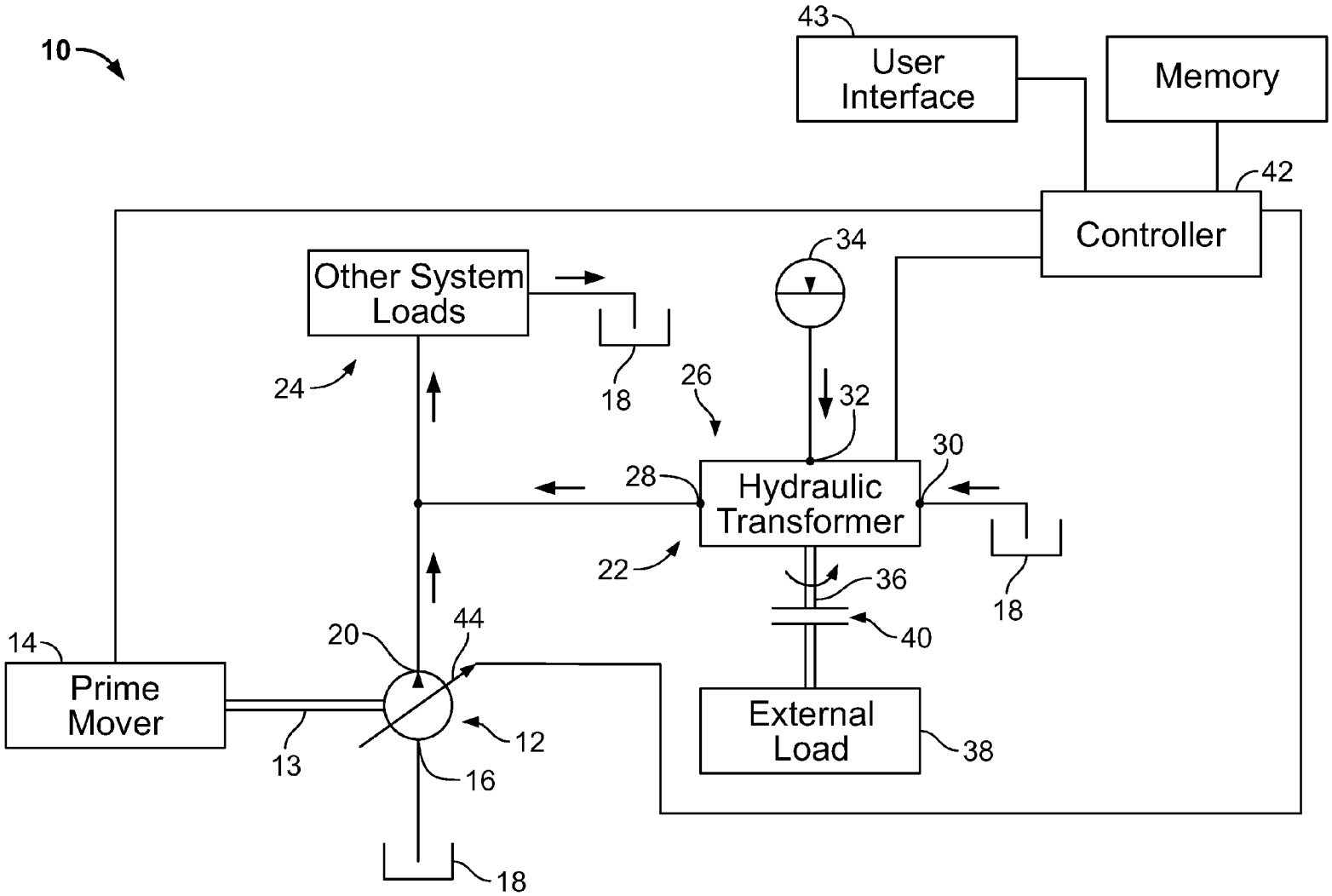

Box 78 of the matrix table 50 is representative of an operating mode/state where the prime mover 14 is operating under a high load condition and the output/input shaft 36 is disconnected from the external load 38. In this condition, the electronic controller 42 controls the transformer 26 such that energy from the accumulator 34 is directed through the hydraulic transformer 26 back toward the pump 12 and the second load circuit 24 for use at the second load circuit 24 (see FIG. 10) to assist in leveling/reducing the load on the prime mover 14. It will be appreciated that the pump 12 and the second load circuit 24 can be referred to as the "system side" of the overall hydraulic system 10.

Figure 11:
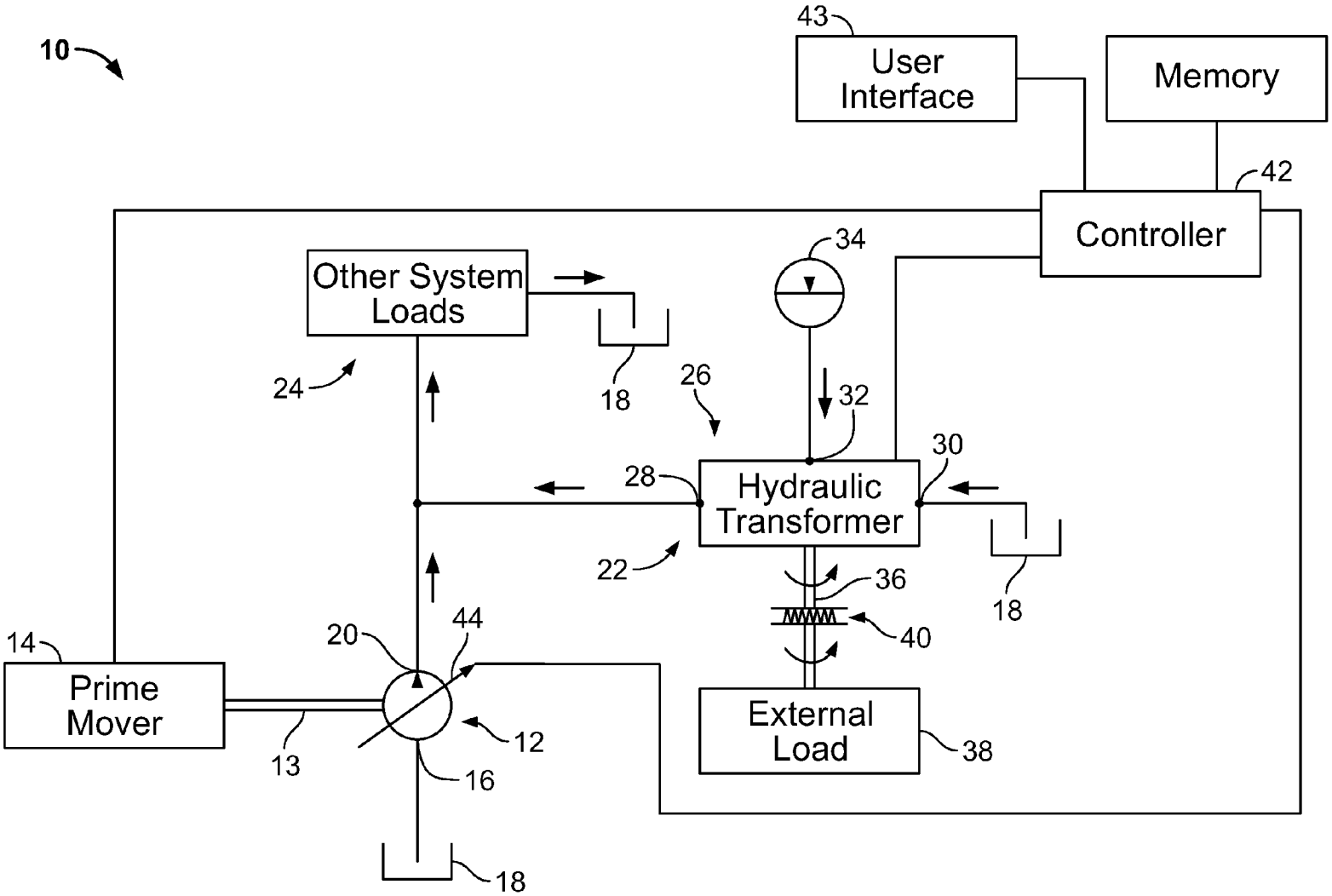

Box 80 of the matrix table 50 is representative of an operating mode/state where the prime mover 14 operating under a high load and the transformer 26 is functioning as a pump in which torque is being transferred into the transformer 26 through the output/input shaft 36. The system 10 operates in this mode/state when the electronic controller 42 receives a command from the operator interface 43 instructing the electronic controller 42 to decelerate rotation of the external load 38. This creates an overrunning condition in which energy corresponding to the movement of the external load 38 (e.g., inertial energy) is converted into torque and transferred into the transformer 26 through the output/input shaft 36. In this mode/state, the electronic controller 42 controls the transformer 26 such that the transformer 26 provides a pumping function that converts the torque derived from the inertial energy of the external load 38 into hydraulic energy which is directed toward the system side of the hydraulic system 10 and used to assist in leveling/reducing the load on the prime mover 14. As energy is transferred to the system side, the transformer 26 functions to brake rotation of the output/input shaft 36 to achieve the desired deceleration. In this condition, the electronic controller 42 can also control the transformer 26 such that energy from the accumulator 34 is concurrently directed back toward the system side of the overall hydraulic system 10 and the second load circuit 24 for use at the second load circuit 24 (see FIG. 11).

Figure 12:
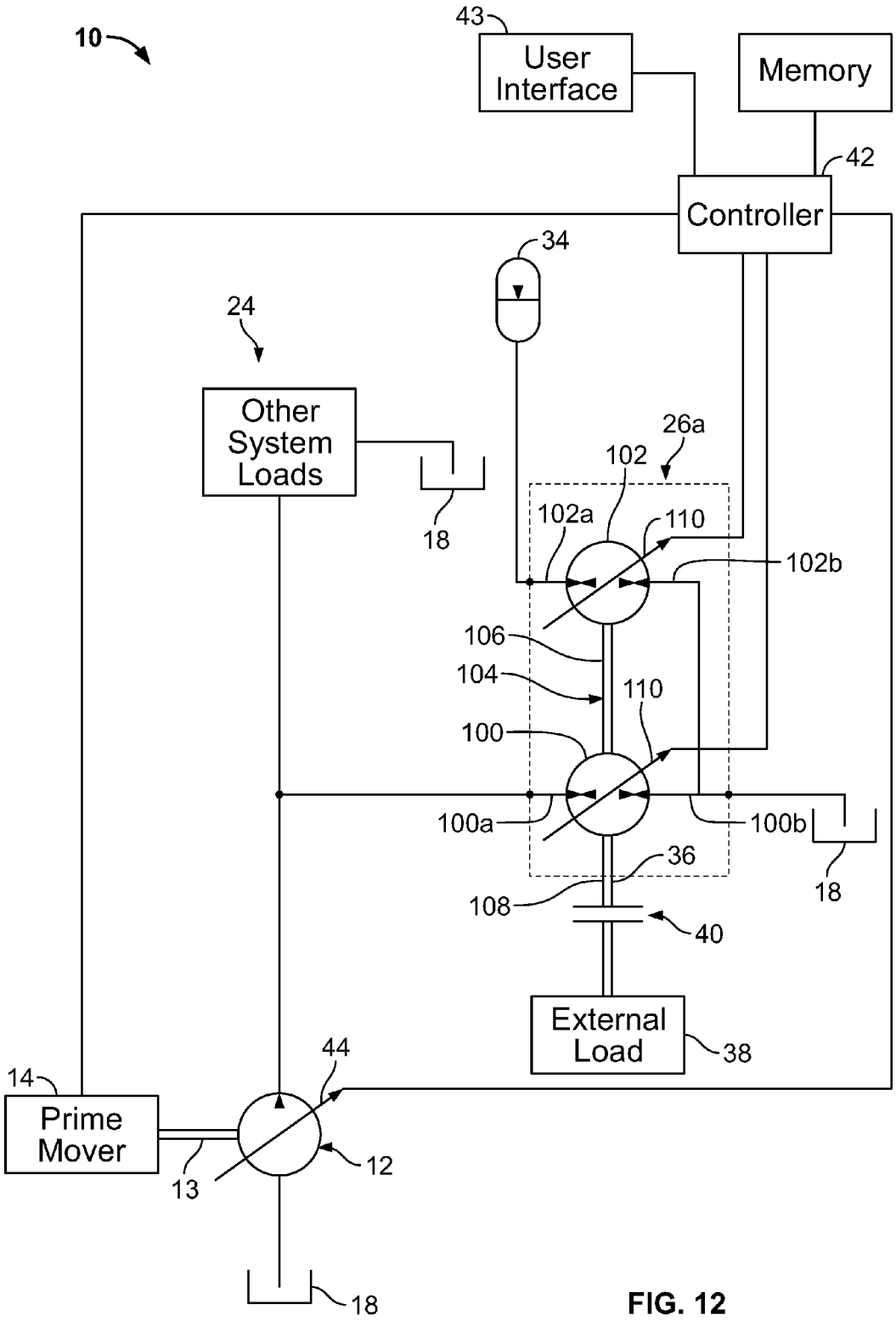
FIG. 12 is a schematic diagram of a second hydraulic system in accordance with the principles of the present disclosure.

FIG. 12 shows the system 10 of FIGS. 1-11 equipped with a hydraulic transformer **26*a* having a plurality of pump/motor units connected by a common shaft. For example, the hydraulic transformer 26*a* includes first and second variable volume positive displacement pump/motor units 100, 102 connected by a shaft 104. The shaft 104 includes a first portion 106 that connects the first pump/motor unit 100 to the second pump/motor unit 102, and a second portion 108 that forms the output/input shaft 36. The first pump/motor unit 100 includes a first side 100*a* fluidly connected to the variable displacement pump 12 and a second side 100*b* fluidly connected to the tank 18. The second pump/motor unit 102 includes a first side 102*a* fluidly connected to the accumulator 34 and a second side 102*b* fluidly connected to the tank 18**.

In one embodiment, each of the first and second pump/motor units 100, 102 includes a rotating group (e.g., cylinder block and pistons) that rotates with the shaft 104, and a swash plate 110 that can be positioned at different angles relative to the shaft 104 to change the amount of pump displacement per each shaft rotation. The volume of hydraulic fluid displaced across a given one of the pump/motor units 100, 102 per rotation of the shaft 104 can be varied by varying the angle of the swash plate 110 corresponding to the given pump/motor unit. Varying the angle of the swash plate 110 also changes the torque transferred between the shaft 104 and the rotating group of a given pump/motor unit. When the swash plates 110 are aligned perpendicular to the shaft 104, no hydraulic fluid flow is directed through the pump/motor units 100, 102. The swash plates 110 can be over-the-center swash plates that allow for bi-directional rotation of the shaft 104. The angular positions of the swash plates 110 are individually controlled by the electronic controller 42 based on the operating condition of the system 10.

Figure 13:
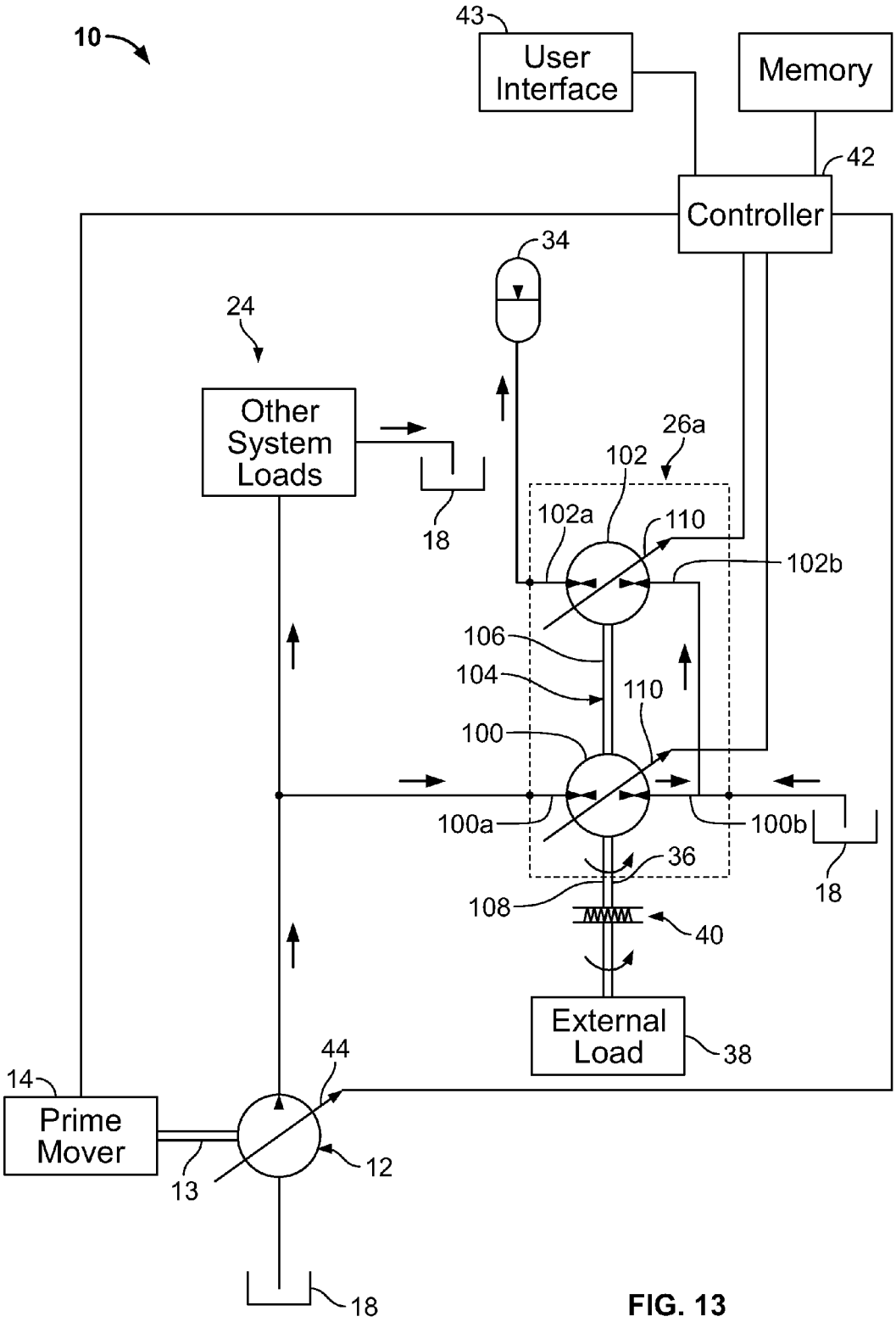
FIGS. 13-21 show the second hydraulic system operating in the various operating modes outlined in the matrix table of FIG. 2.
Figure 14:
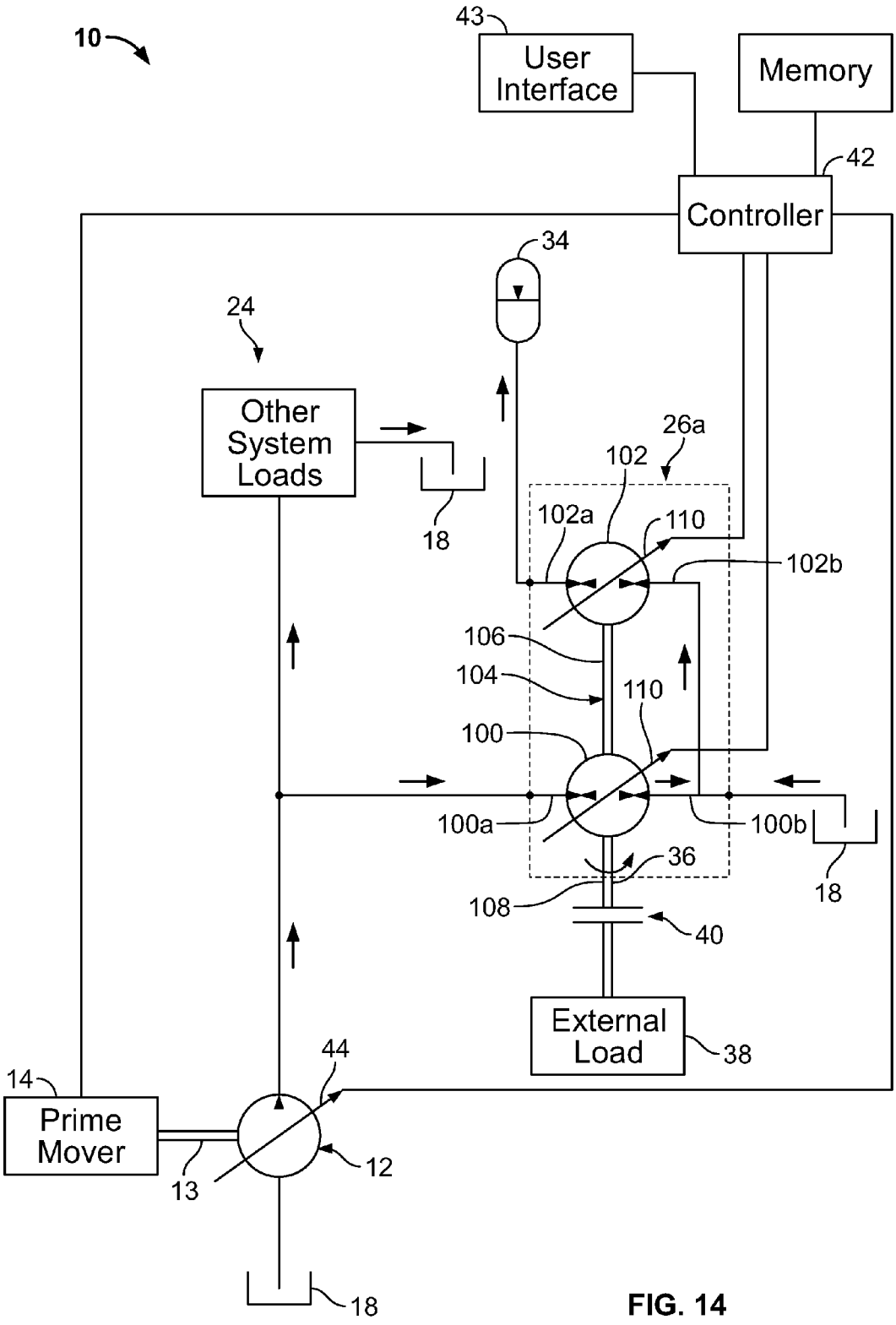
Figure 15:
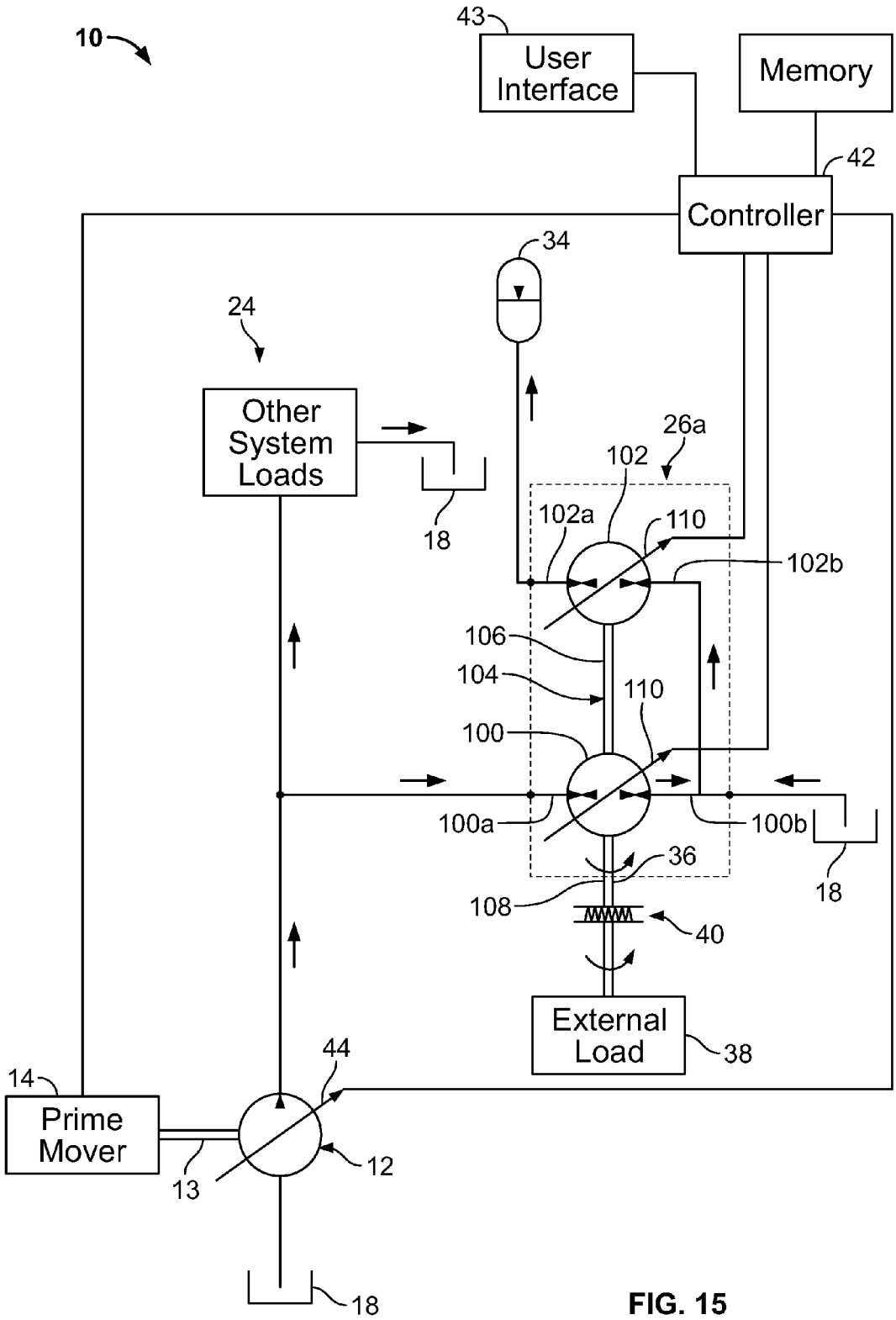
Figure 16:
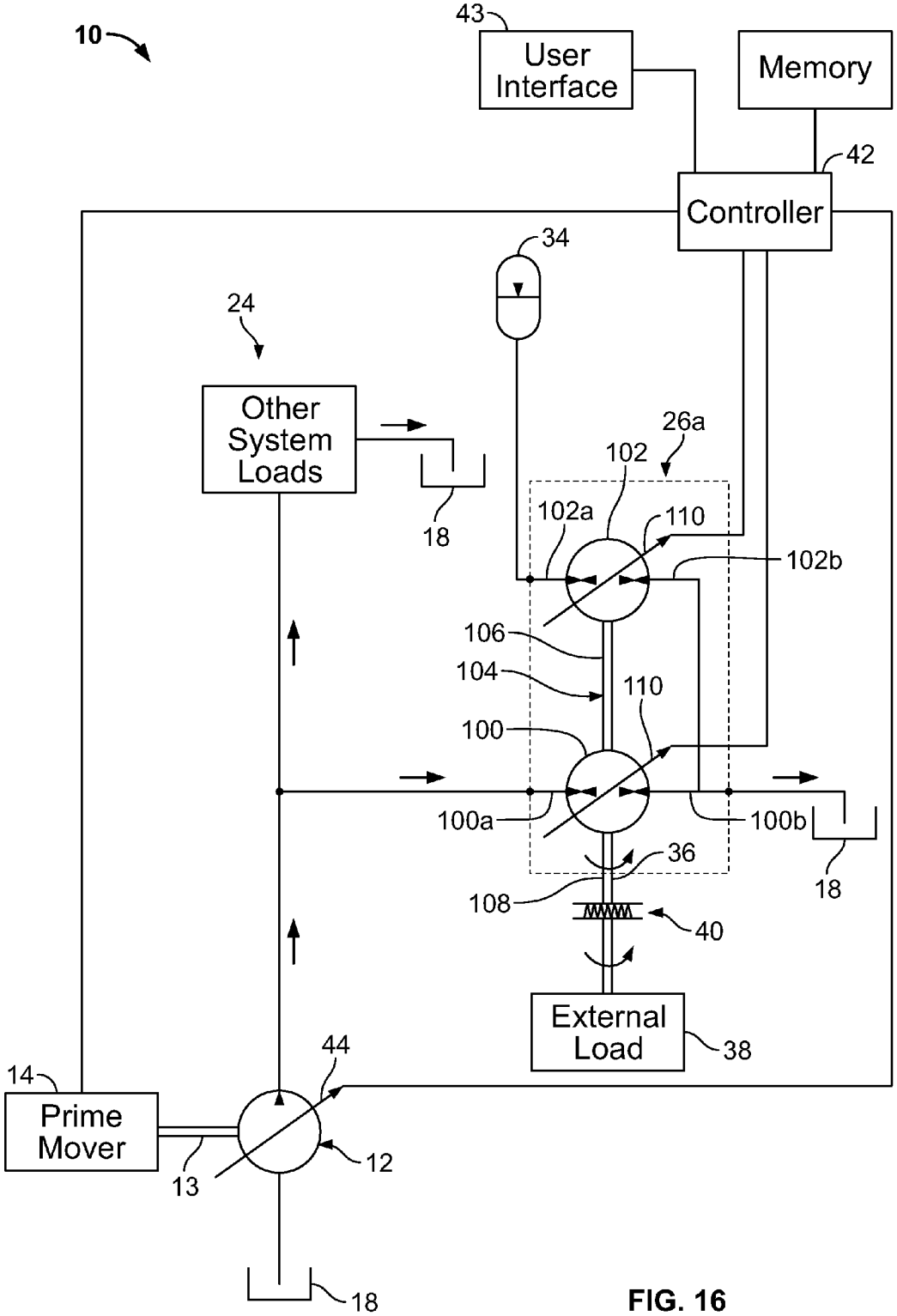
Figure 17:
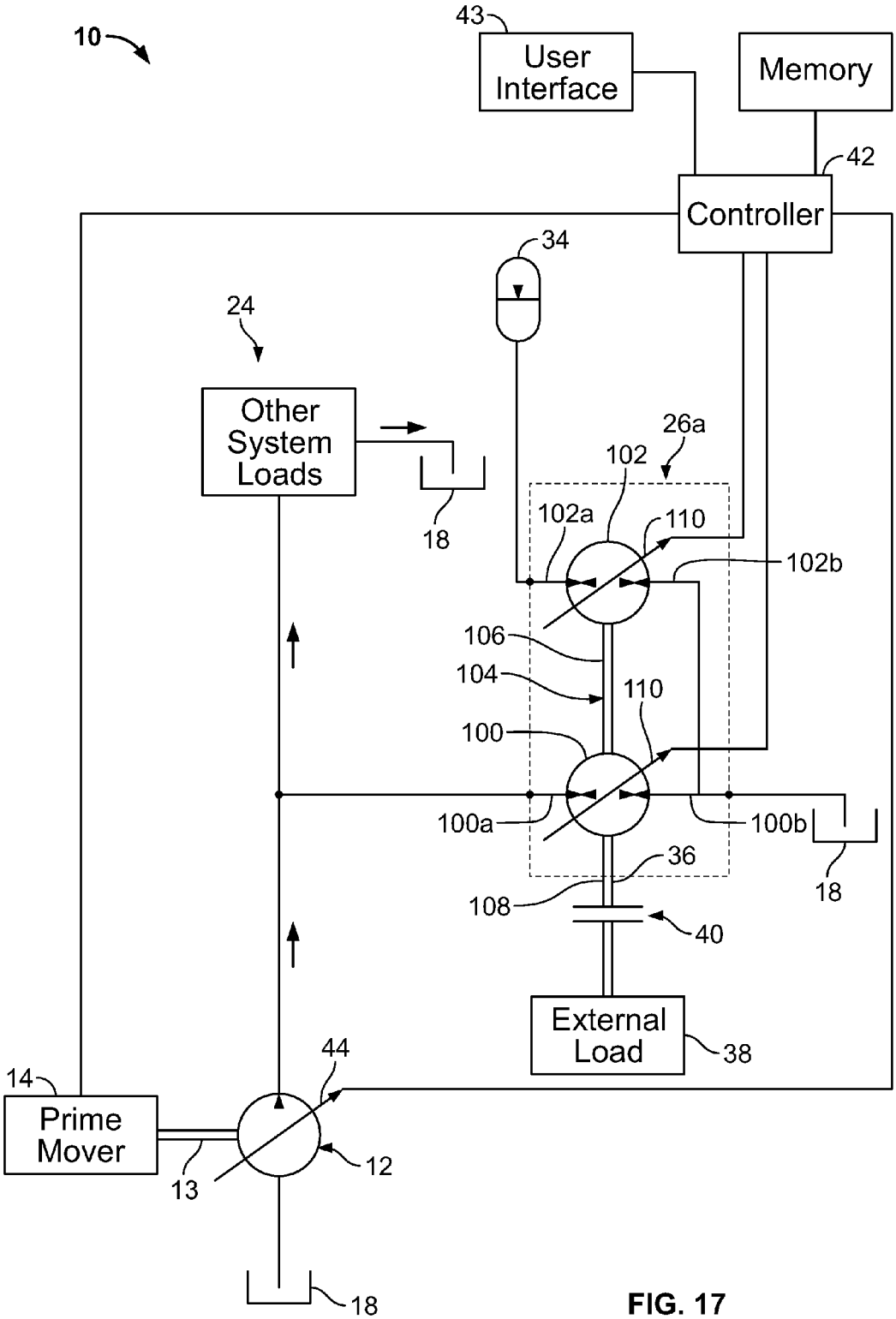
Figure 18:
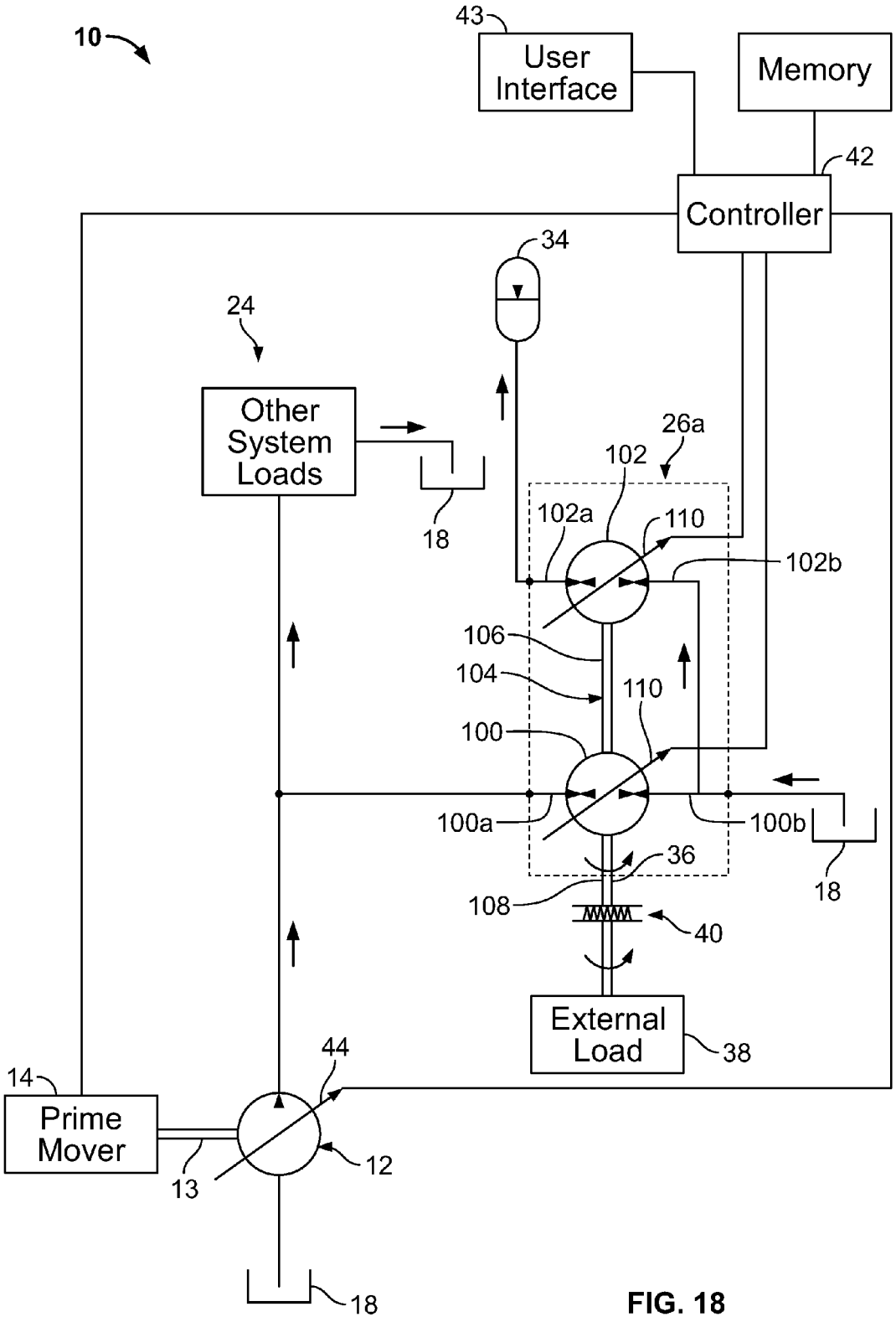
Figure 19:
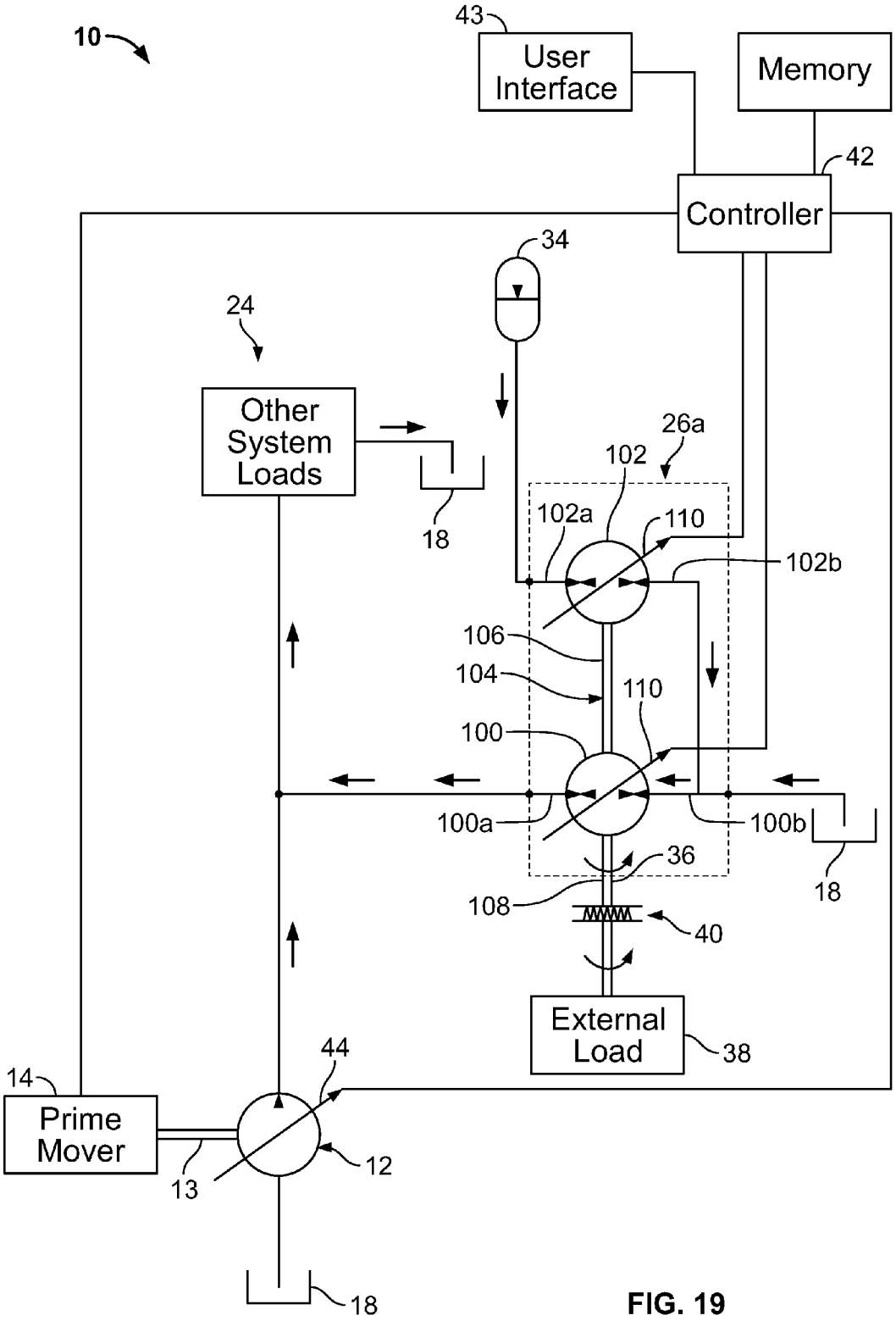
Figure 20:
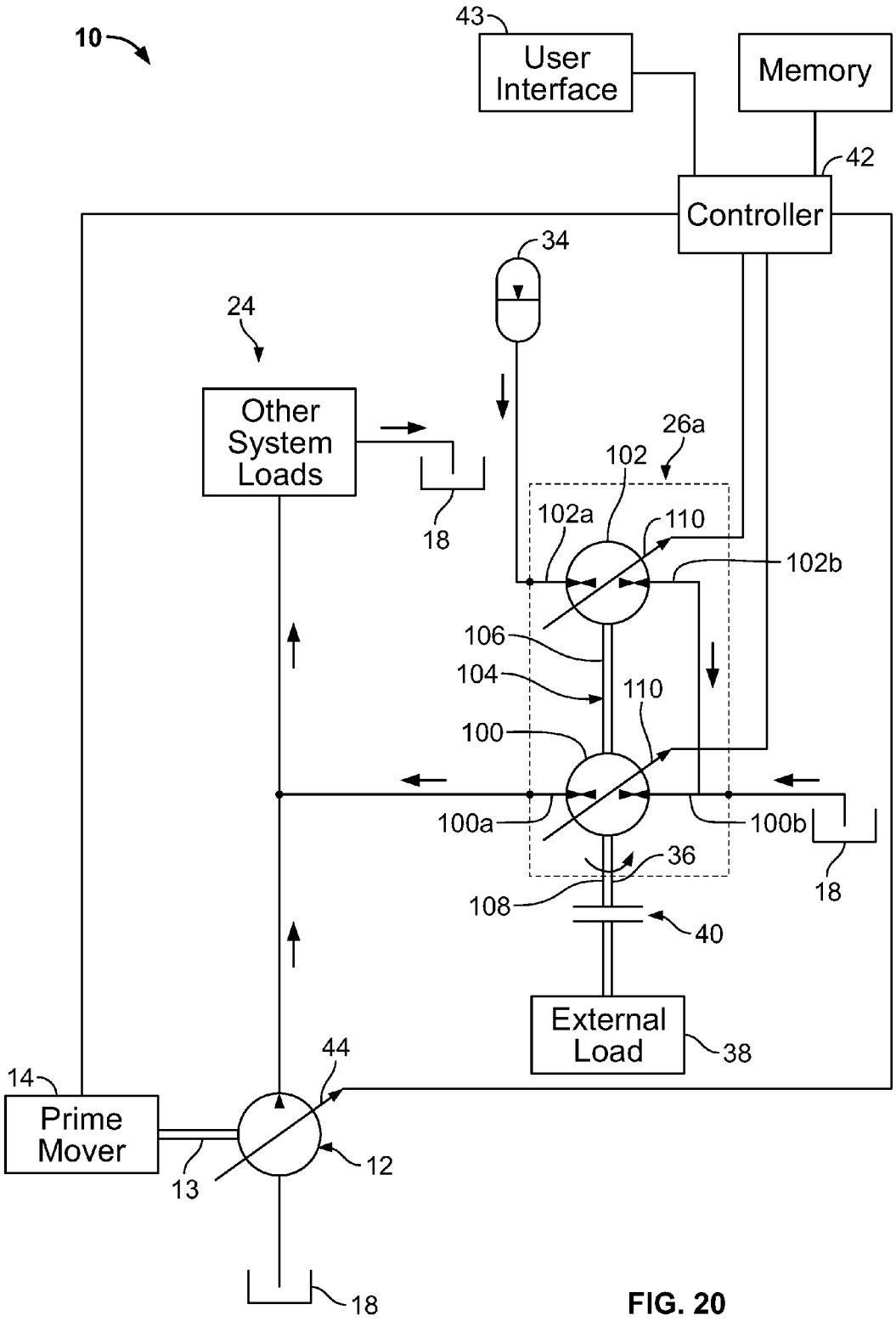
Figure 21:
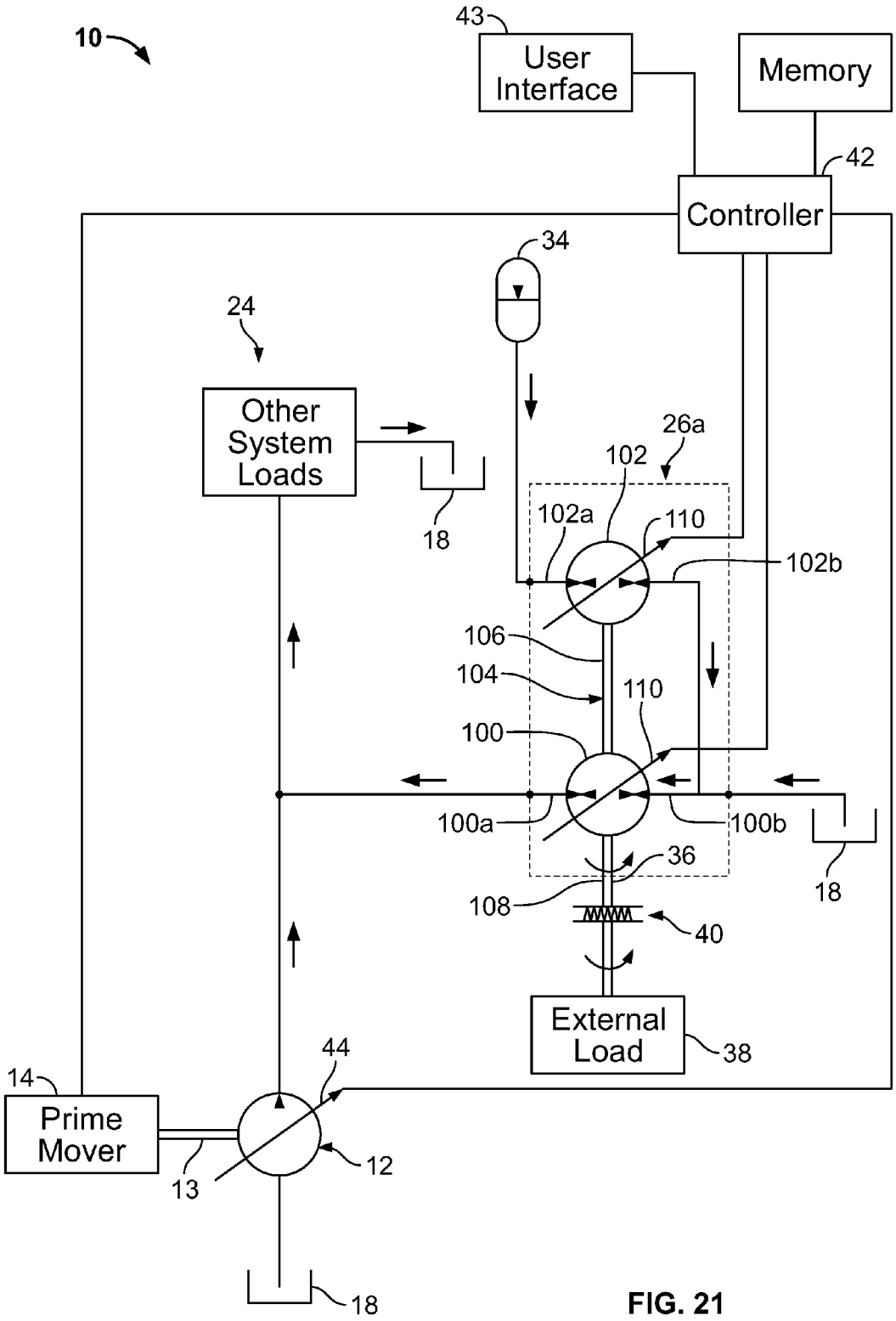

By controlling the positions of the swash plates 110, the controller 42 can operate the system 10 in any one of the operating modes set forth in the matrix table 50 of FIG. 2. When the system 10 is operated in the mode of box 64, the first pump/motor unit 100 uses power from the pump 12 to turn the shaft 104 and drive the external load 38, and the second pump/motor unit 102 takes power off the shaft 104 and uses the power to pump hydraulic fluid into the accumulator 34 (see FIG. 13). When the system 10 is operated in the mode of box 66, the first pump/motor unit 100 uses power from the pump 12 to turn the shaft 104, and the second pump/motor unit 102 takes power off the shaft 104 and uses the power to pump hydraulic fluid into the accumulator 34 to charge the accumulator 34 (see FIG. 14). When the system 10 is operated in the mode of box 68, inertial energy from the moving external load 38 turns the shaft 104, and the second pump/motor unit 102 takes power off the shaft 104 and uses the power to pump hydraulic fluid into the accumulator 34 to charge the accumulator 34 (see FIG. 15). Energy from the pump 12 can also be concurrently used to charge the accumulator 34. When the system 10 is operated in the mode of box 70, the first pump/motor unit 100 uses power from the pump 12 to turn the shaft 104 and drive the external load 38, and the second pump/motor unit 102 is set to zero displacement (see FIG. 16). When the system 10 is operated in the mode of box 72, both of the pump/motor units 100, 102 are set to zero displacement (see FIG. 17). When the system 10 is operated in the mode of box 74, inertial energy from the moving external load 38 turns the shaft 104, and the second pump/motor unit 102 takes power off the shaft 104 and uses the power to pump hydraulic fluid into the accumulator 34 to charge the accumulator 34, and the first pump/motor 100 is set to zero displacement (see FIG. 18). When the system 10 is operated in the mode of box 76, the second pump/motor unit 102 uses power from the charged accumulator 34 to turn the shaft 104 and drive the external load 38, and the first pump/motor unit 101 pumps hydraulic fluid back toward the pump 12 and the second load circuit 24 (see FIG. 19). When the system 10 is operated in the mode of box 78, the second pump/motor unit 102 uses power from the charged accumulator 34 to turn the shaft 104, and the first pump/motor unit 101 pumps hydraulic fluid back toward the pump 12 and the second load circuit 24 (see FIG. 20). When the system 10 is operated in the mode of box 80, the second pump/motor unit 102 uses power from the charged accumulator 34 to turn the shaft 104, inertial energy from the moving external load 38 also turns the shaft 104, and the first pump/motor unit 101 pumps hydraulic fluid back toward the pump 12 and the second load circuit 24 (see FIG. 21).

By controlling the displacement rates and displacement directions of the pump/motor units 100, 102, fluid power (pressure times flow) at a particular level can be converted to an alternate level, or supplied as shaft power used to drive the external load 38. When a deceleration of the external load 38 is desired, the hydraulic transformer 26*a* can act as a pump taking low pressure fluid from the tank 18 and directing it either to the accumulator 34 for storage, to the second load circuit 24 connected to the variable displacement pump 12, or a combination of the two. By using the clutch 40 to disengage the output/input shaft 36 from the external load 38, the hydraulic transformer 26*a* can function as a stand-alone hydraulic transformer (e.g., a conventional hydraulic transformer) when no shaft work is required to be applied to the external load 38. This is achieved by taking energy from the system 10 at whatever pressure is dictated by the other associated system loads (e.g., the load corresponding to the second load circuit 24) and storing the energy, without throttling, at the current accumulator pressure. In the same way, unthrottled energy can also be taken from the accumulator 34 at its current pressure and supplied to the system 10 at the desired operating pressure. Proportioning of power flow by the hydraulic transformer 26*a* can be controlled by controlling the positions of the swash plates 110 on the pump/motor units 100, 102. In certain embodiments, aspects of the present disclosure can be used in systems without a clutch for disengaging a connection between the output/input shaft 36 and the external load 38.

Figure 22:
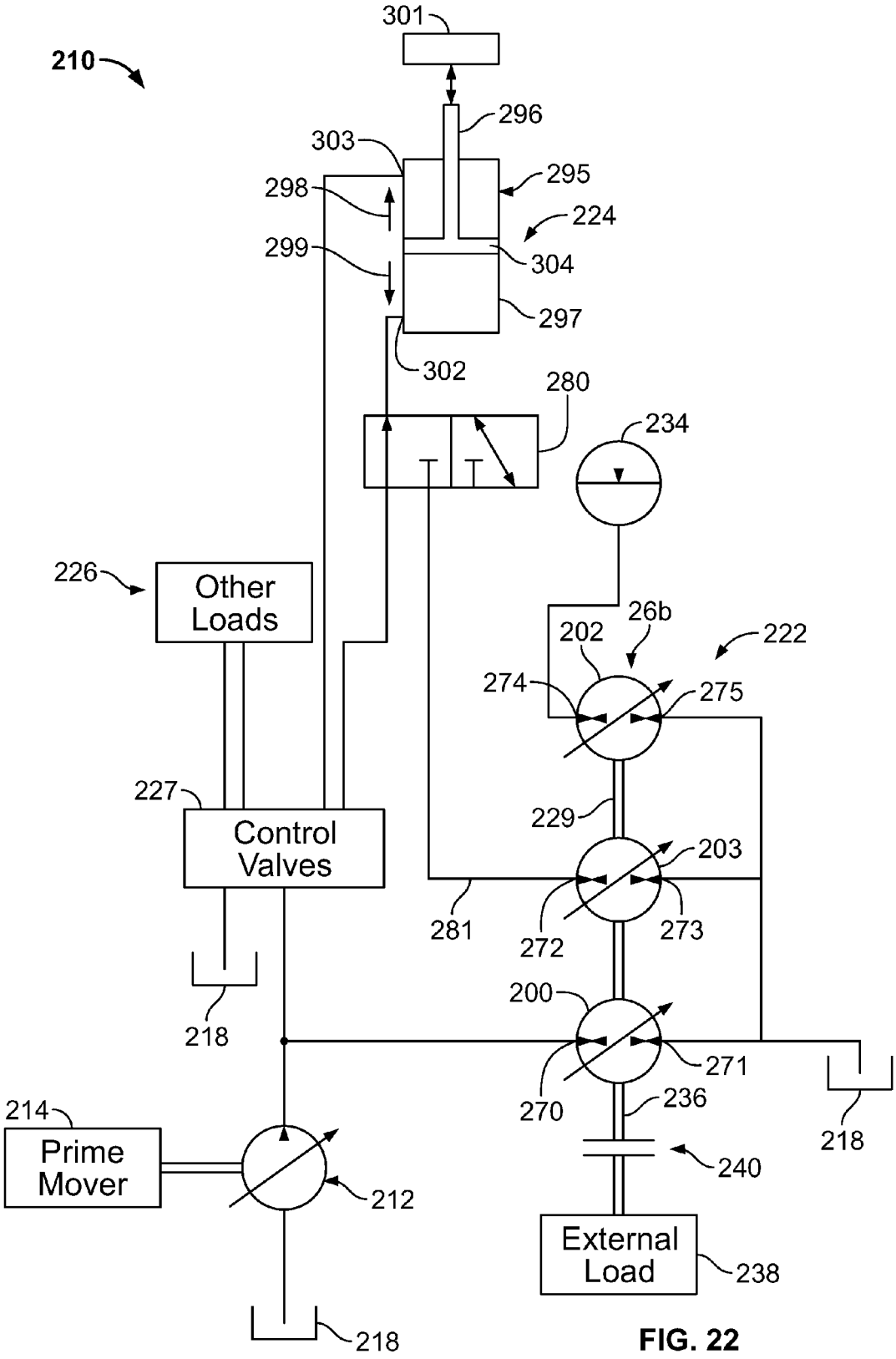
FIGS. 22 and 23 are schematic diagrams showing two operating configurations of a third hydraulic system in accordance with the principles of the present disclosure.

FIG. 22 shows another system 210 in accordance with the principles of the present disclosure. This system 210 includes a variable displacement pump 212 powered by a prime mover 214. The variable displacement pump 212 draws hydraulic fluid from a tank 218 and outputs pressurized hydraulic fluid for powering a first load circuit 222, a second load circuit 224, and a third load circuit 226. A control valve arrangement 227 controls fluid communication between the variable displacement pump 212 and the second and third load circuits 224, 226. The first load circuit 222 includes a hydraulic transformer 26*b* including three rotating groups connected by a common shaft 229. The common shaft 229 includes an end portion forming an output/input shaft 236. A clutch 240 is used to selectively couple the output/input shaft 236 to an external load 238 and to selectively decouple the output/input shaft 236 from the external load 238.

The rotating groups of the hydraulic transformer 26*b* include a first variable displacement pump/motor unit 200, a second variable displacement pump/motor unit 202, and a third variable displacement pump/motor unit 203. A first side 270 of the first pump/motor unit 200 is fluidly connected to an output side of the variable displacement pump 212 and a second side 271 of the first pump/motor unit 200 is fluidly connected to the tank 218. A first side 272 of the third pump/motor unit 203 is fluidly connected to a flow line 281 that connects to the second load circuit 224. A flow control valve 280 is positioned along the flow line 281. A second side 273 of the third pump/motor unit 203 is fluidly connected to the tank 218. A first side 274 of the second pump/motor unit 202 is fluidly connected to a hydraulic pressure accumulator 234, and a second side 275 of the third pump/motor unit 203 is fluidly connected to the tank 218. The pump/motors 200, 202, and 203 can have the same type of configuration as the pump/motors previously described herein.

The second load circuit 224 includes a hydraulic cylinder 295 having a piston 296 mounted within a cylinder body 297. The piston 296 is movable in a lift stroke direction 298 and a return stroke direction 299. When the piston 296 is moved in the lift stroke direction 298, the hydraulic cylinder 295 is used to lift or move a work element 301 (e.g., a boom) against a force of gravity. The work element 301 moves with the force of gravity when the piston 296 moves in the return stroke direction 299. The cylinder body 297 defines first and second ports 302, 303 positioned on opposite sides of a piston head 304 of the piston 296.

To drive the piston 296 in the lift stroke direction 298, hydraulic fluid is pumped from the pump 212 through the control valve arrangement 227 and the flow control valve 280 into the cylinder body 297 through the first port 302. Concurrently, movement of the piston head 304 in the lift stroke direction 298 forces hydraulic fluid out of the cylinder body 297 through the second port 303. The hydraulic fluid exiting the cylinder body 297 through the second port 303 flows through the control valve arrangement 227 which directs the hydraulic fluid to the tank 218.

Figure 23:
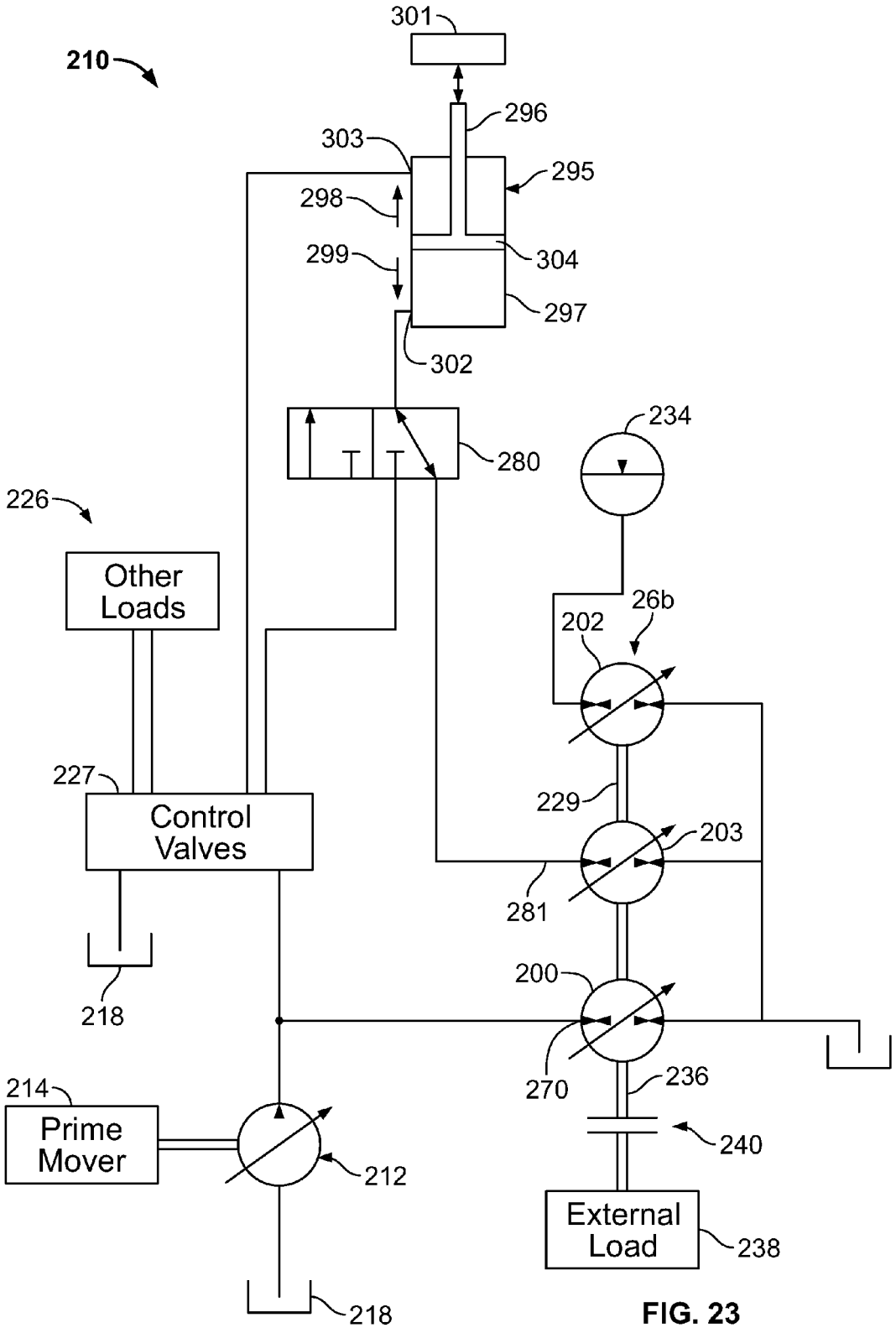

To move the piston 296 in the return stroke direction 299, hydraulic fluid is pumped from the pump 212 through the control valve arrangement 227 into the cylinder body 297 through the second port 303. Concurrently, movement of the piston head 304 in the return stroke direction 299 forces hydraulic fluid out of the cylinder body 297 through the first port 302. Movement of the piston head 304 in the return stroke direction 299 is gravity assisted/powered (e.g., by the weight of the lifted work element 301) causing the hydraulic fluid exiting the first port 302 to be pressurized. By shifting the flow control valve 280 as shown at FIG. 23, the hydraulic fluid output from the first port 302 during the return stroke of the piston 296 can be routed through the flow line 281 to the third pump/motor unit 203 such that energy from the pressurized fluid exiting the cylinder body 297 can be used to drive the common shaft 229. As the common shaft 229 is driven by pressure released from the hydraulic cylinder 295, energy corresponding to the return stroke of the piston 296 can be transferred to the accumulator 234 through the second pump/motor unit 202 and/or can be transferred to the external load 238 through the output/input shaft 236. Additionally, the energy can also be transferred back toward the variable displacement pump 212 in the form of pressurized hydraulic fluid pumped out the first side 270 of the first pump/motor unit 200. In this way, the hydraulic transformer 26*b* allows for the recovery and use of potential energy corresponding to the lifted weight of the work element 301 which was elevated during the lift stroke of the hydraulic cylinder 295.

Similar to the previously described embodiments, the transformer 26*b* and accumulator 234 also allow excess energy from the pump 212 to be stored in the accumulator 234 to provide an energy buffering function. Also, similar to the previously described embodiments, energy corresponding to a deceleration of the working load 238 can be stored in the accumulator 234 for later use and/or directed back toward the pump 212 for use at the second or third load circuits 224, 226 to provide a load leveling function. Additionally, the valve 280 and third pump/motor unit 203 also allow energy from the accumulator 34 or corresponding to a deceleration of the working load 238 to be used to drive the piston 296 in the lift direction 298. As compared to the modes set forth at FIG. 2, the addition of the third pump/motor unit 203 linked to another circuit that can both draw power and supply power provides additional sets of operating modes/options.

Figure 24:
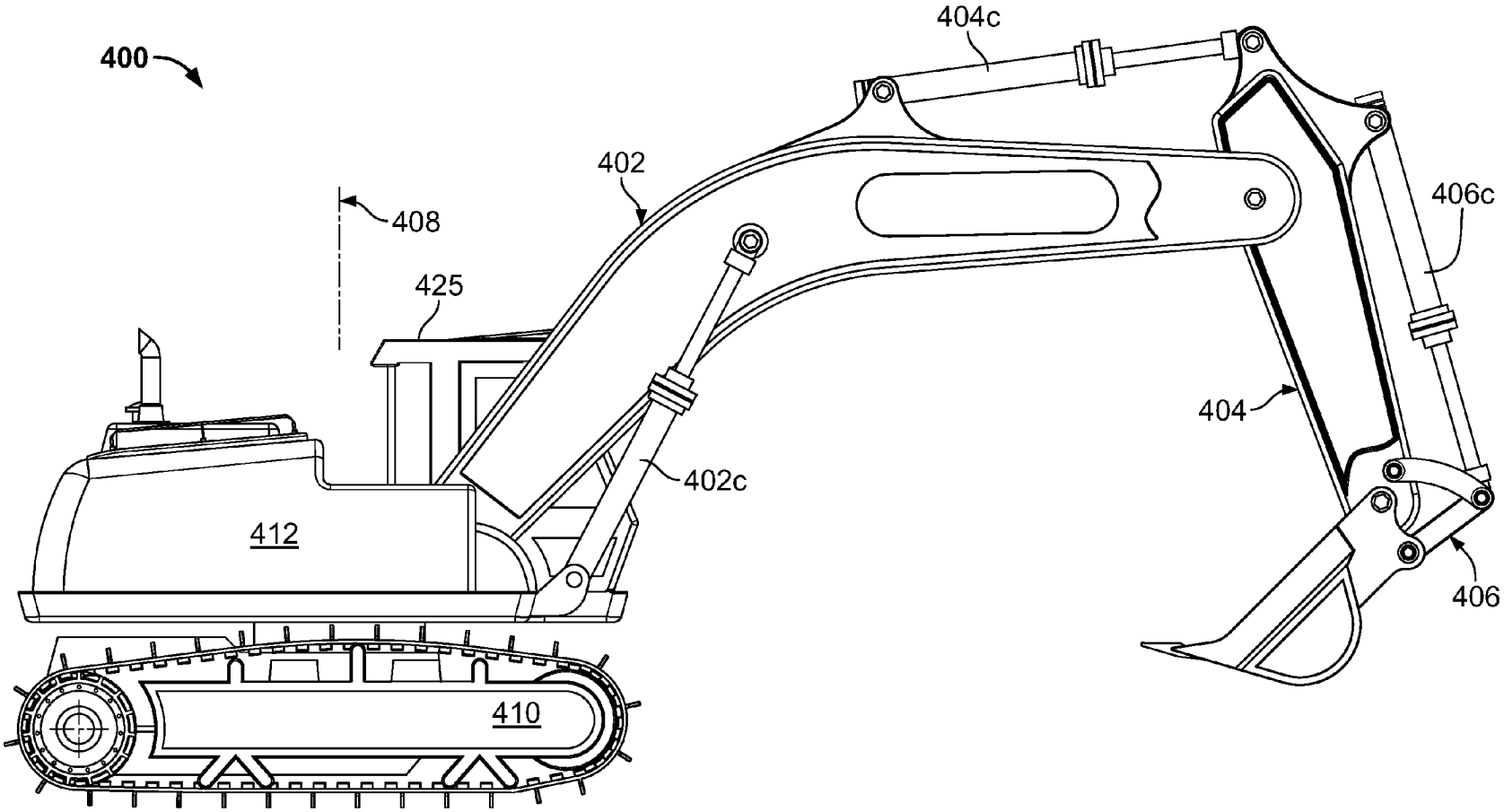
FIGS. 24 and 25 show a mobile piece of excavation equipment that is an example of one type of machine on which hydraulic systems in accordance with the principles of the present disclosure can be used.
Figure 25:
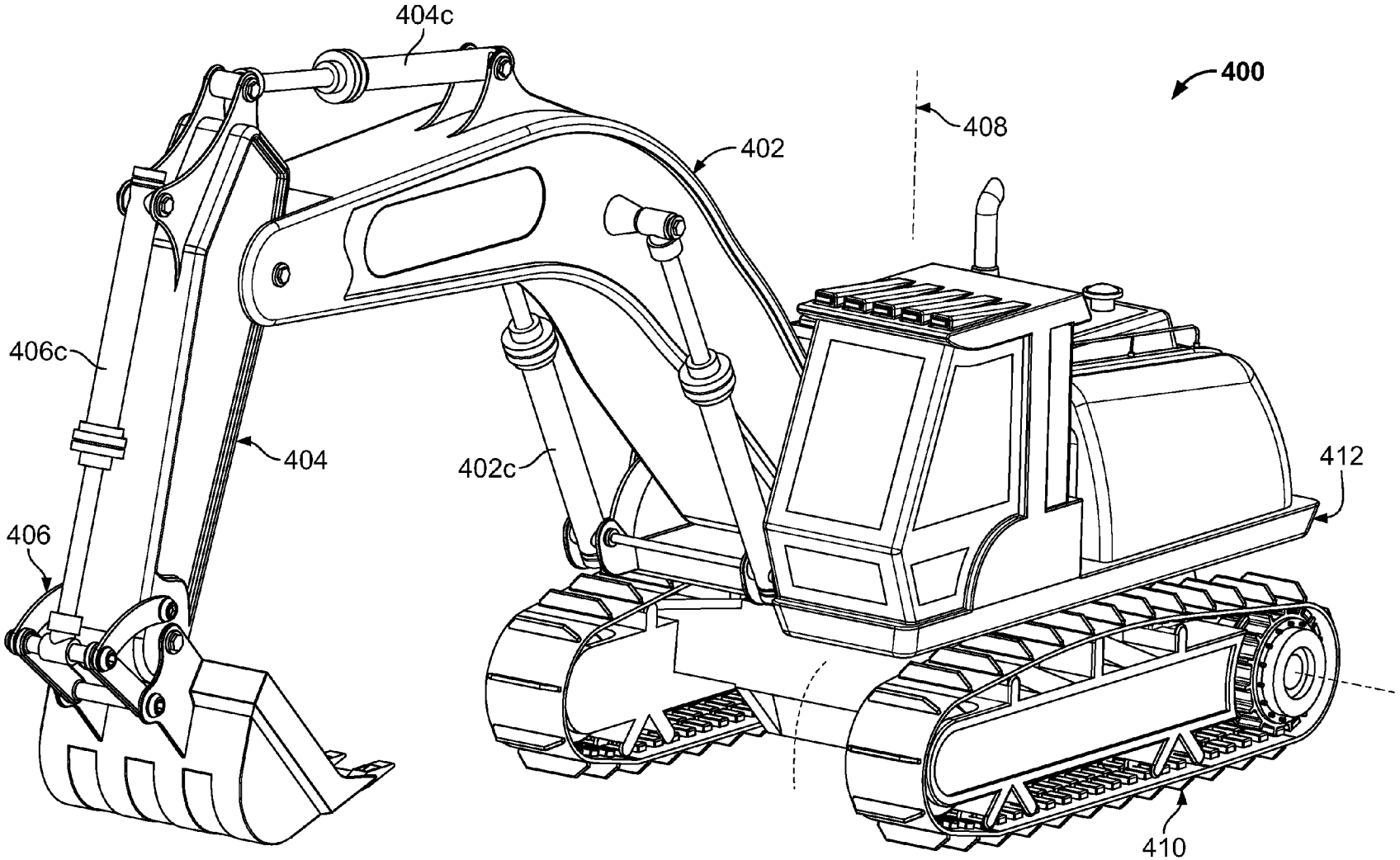

In one example embodiment, hydraulic circuit configurations of the type described above can be incorporated into a piece of mobile excavation equipment such as an excavator. For example, FIGS. 24 and 25 depict an example excavator 400 including an upper structure 412 supported on an undercarriage 410. The undercarriage 410 includes a propulsion structure for carrying the excavator 400 across the ground. For example, the undercarriage 410 can include left and right tracks. The upper structure 412 is pivotally movable relative to the undercarriage 410 about a pivot axis 408 (i.e., a swing axis). In certain embodiments, transformer input/output shafts of the type described above can be used for pivoting the upper structure 412 about the swing axis 408 relative to the undercarriage 410.

The upper structure 412 can support and carry the prime mover 14 of the machine and can also include a cab 425 in which an operator interface is provided. A boom 402 is carried by the upper structure 412 and is pivotally moved between raised and lowered positions by a boom cylinder 402*c*. An arm 404 is pivotally connected to a distal end of the boom 402. An arm cylinder 404*c* is used to pivot the arm 404 relative to the boom 402. The excavator 400 also includes a bucket 406 pivotally connected to a distal end of the arm 404. A bucket cylinder 406*c* is used to pivot the bucket 406 relative to the arm 404. In certain embodiments, the boom cylinder 402*c*, the arm cylinder 404*c*, and the bucket cylinder 406*c* can be part of system load circuits of the type described above. For example, the hydraulic cylinder 295 of the embodiment of FIGS. 22 and 23 can function as the boom cylinder 402*c*.

Figure 26:
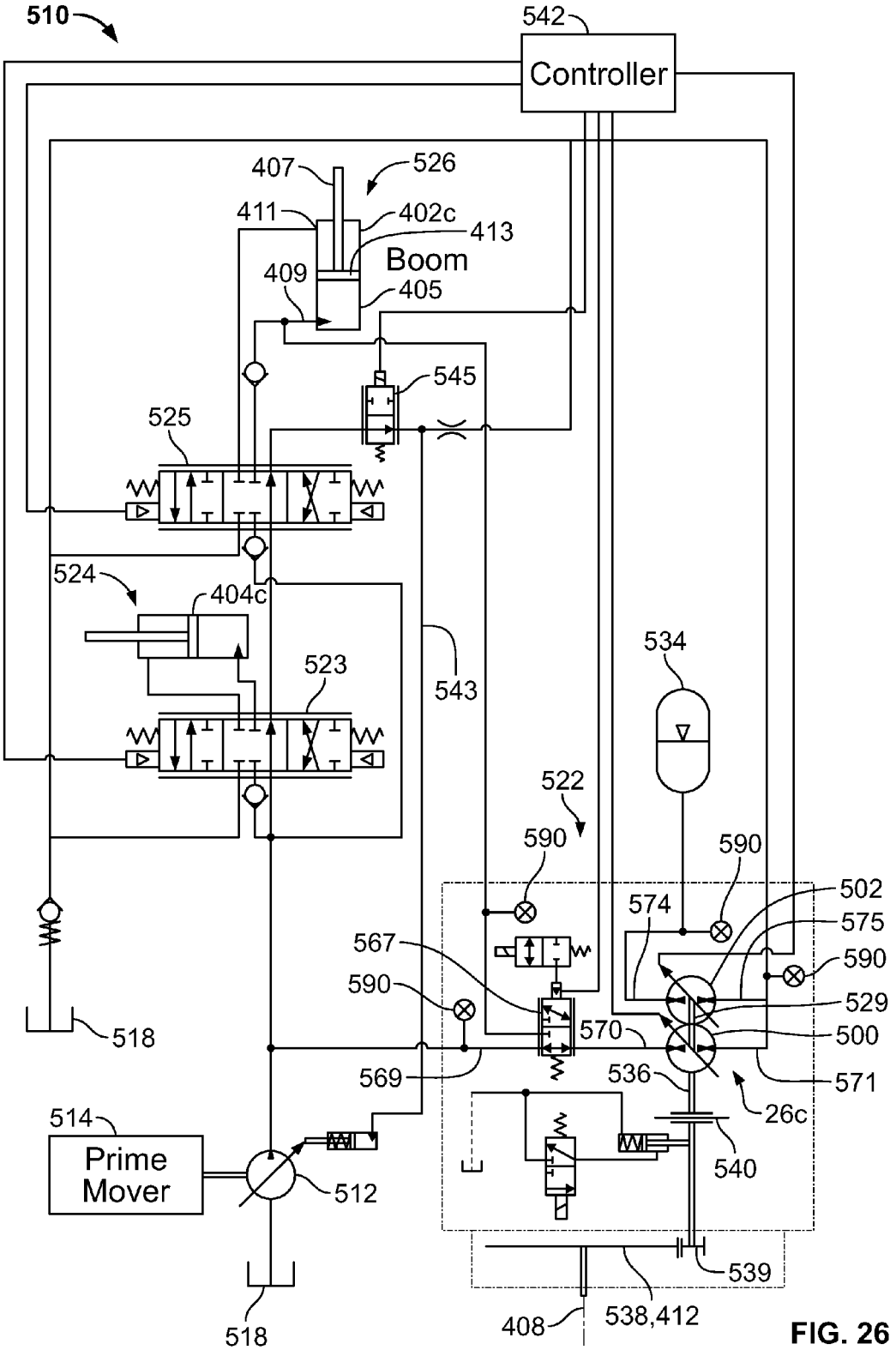
FIGS. 26 and 27 are schematic diagrams showing two operating configurations of a third hydraulic system in accordance with the principles of the present disclosure.
Figure 27:
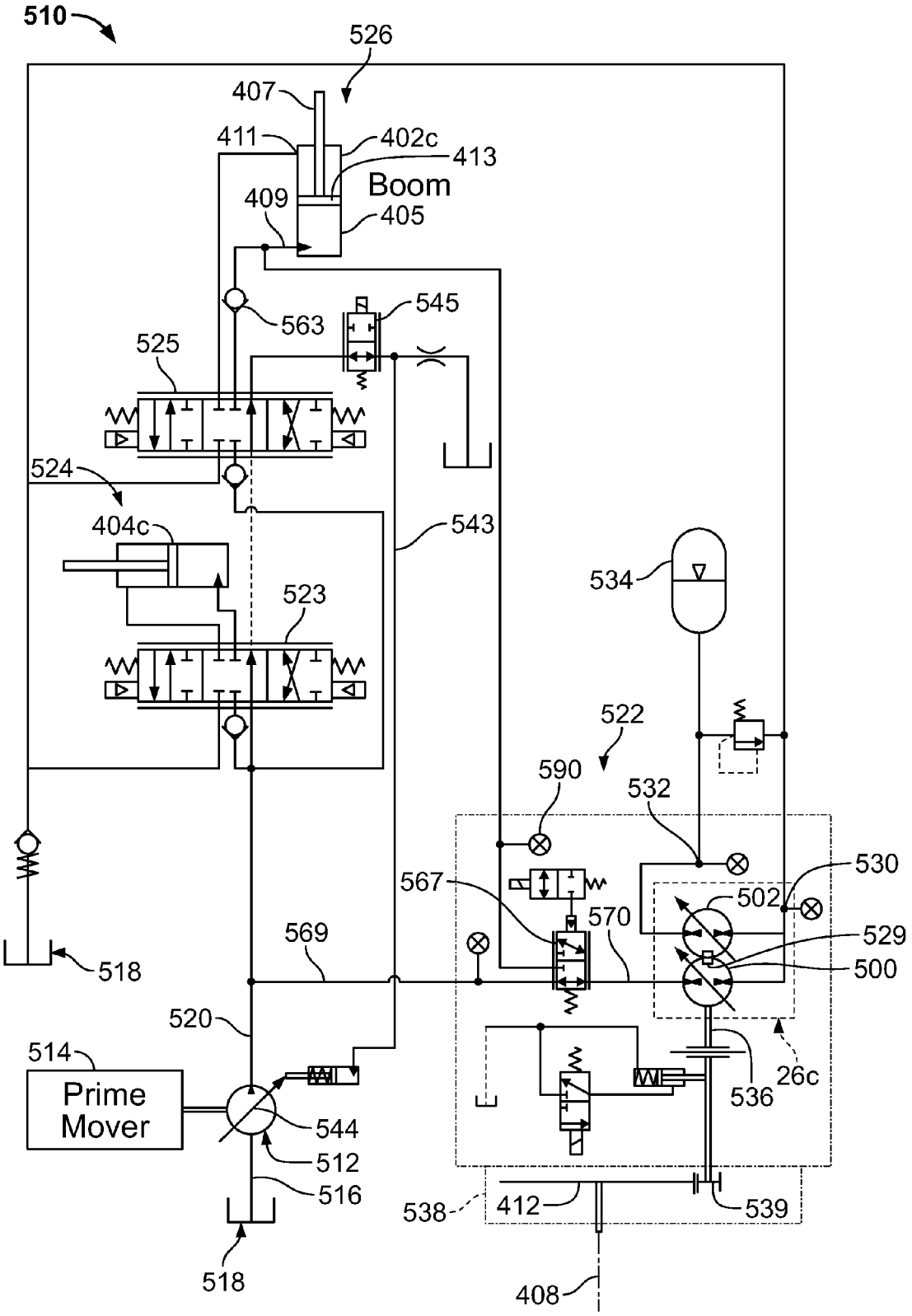

FIGS. 26 and 27 illustrate another system 510 in accordance with the principles of the present disclosure that is adapted for use with the excavator 400. This system 510 includes a variable displacement pump 512 powered by a prime mover 514. The variable displacement pump 512 can include a swash plate 544 for controlling the pump displacement volume per shaft rotation. A system controller 542 can interface with a negative flow control circuit 543 having a negative flow control orifice valve 545. The negative flow control circuit 543 allows a negative flow control (NFC) pump control strategy to be used to control operation of the pump 512. The variable displacement pump 512 draws hydraulic fluid from a tank 518 and outputs pressurized hydraulic fluid for powering a first load circuit 522, a second load circuit 524, and a third load circuit 526. The second load circuit 524 includes the arm cylinder 404*c* and the third load circuit 526 includes the boom cylinder 402*c*. A direction flow control valve 523 controls fluid flow between the arm cylinder 404*c* and the pump 512 and the tank 518. A direction flow control valve 525 controls fluid flow between the boom cylinder 402*c* and the pump 512 and the tank 518. The first load circuit 522 includes a hydraulic transformer 26*c* including two rotating groups connected by a common shaft 529. The common shaft or shafts 529 include an end portion forming an output/input shaft 536. A clutch 540 is used to selectively couple the output/input shaft 536 to an external load 538 and to selectively decouple the output/input shaft 536 from the external load 538. The output/input shaft 536 is preferably used to pivot (i.e., swing) the upper structure 412 of the excavator 400 about the pivot axis 408 relative to the undercarriage 410. Thus, the external load 538 represents the load used to accelerate and decelerate pivotal movement of the upper structure 412 about the pivot axis 408. A gear reduction 539 is shown between the clutch 540 and the upper structure 412.

The rotating groups of the hydraulic transformer 26*c* include a first variable displacement pump/motor unit 500 and a second variable displacement pump/motor unit 502. A first side 570 of the first pump/motor unit 500 is fluidly connected to an output side of the variable displacement pump 512 and a second side 571 of the first pump/motor unit 500 is fluidly connected to the tank 518. A flow line 569 connects the second side 571 of the first pump/motor unit 500 to the output side of the pump 512. A first side 574 of the second pump/motor unit 502 is fluidly connected to a hydraulic pressure accumulator 534, and a second side 575 of the second pump/motor unit 502 is fluidly connected to the tank 518. The pump/motors 500, 502 can have the same type of configuration as the pump/motors previously described herein.

The boom cylinder 402*c* includes a cylinder 405 and a piston 407. The cylinder 405 defines first and second ports 409, 411 on opposite sides of a piston head 413 of the piston 407.

A flow control valve 567 (i.e., a mode valve) is positioned along the flow line 569. The flow control valve 567 is movable between first and second positions. In the first position, the flow control valve 567 fluidly connects the output side of the pump 512 to the first side 570 of the first pump/motor unit 500. In the second position (shown at FIG. 27), the flow control valve 567 fluidly connects the first port 409 of the cylinder 405 to the first side 570 of the first pump/motor unit 500. To move the piston 407 in a lift/extension stroke to lift the boom 402, the first port 409 may be placed in fluid communication with the output side of the pump 512 and the second port 411 may be placed in fluid communication with the tank 518, and/or the first port 409 may be placed in fluid communication with the first side 570 of the first pump/motor unit 500 and the second port 411 may be placed in fluid communication with the tank 518. To move the piston 407 in a return direction to lower the boom 402, the first port 409 may be placed in fluid communication with the first side 570 of the first pump/motor unit 500 through the flow control valve 567. A one-way check valve 563 prevents the first port 409 from being placed in fluid communication with the tank 518 as the boom 402 is lowered in this configuration. It will be appreciated that the weight of the boom 402 pressurizes the hydraulic fluid exiting the first port 409 as the boom 402 is lowered. By directing such pressurized hydraulic fluid to the transformer 26*c*, potential energy corresponding to the weight of the elevated boom 402 can be recovered and stored in the accumulator 534 and/or can be transferred to the external load 538 through the output/input shaft 536. Additionally, in certain embodiments, the energy can also be transferred back toward the variable displacement pump 512 in the form of pressurized hydraulic fluid pumped out of the first side 570 of the first pump/motor unit 500. In this way, the hydraulic transformer 26*c* allows for the recovery and use of potential energy corresponding to the lifted weight of the boom 402 which was elevated during the lift stroke of the hydraulic cylinder 402*c*.

Similar to the previously described embodiments, the transformer 26*c* and accumulator 534 also allow excess energy from the pump 512 to be stored in the accumulator 534 to provide an energy buffering function. Also, similar to the previously described embodiments, energy corresponding to a deceleration of the working load 538 can be stored in the accumulator 534 for later use, directed to the boom cylinder 402*c*, and/or directed back toward the pump 512 for use at the second or third load circuits 524, 526 to provide a load leveling function. Hydraulic fluid pressure sensors 590 interfacing with the controller 542 are provided throughout the system 510.

What is claimed is:

1. A hydraulic system comprising:

an accumulator; and a hydraulic transformer including first and second variable displacement pump/motor units connected to a rotatable shaft, the rotatable shaft adapted for mechanical connection to an external working load, the first variable displacement pump/motor unit including a first side that fluidly connects to a pump and a second side that fluidly connects to a tank, the second variable displacement pump/motor unit including a first side that fluidly connects to the accumulator and a second side that fluidly connects with the tank, wherein the hydraulic transformer is part of a first load circuit powered at substantially pump outlet pressure by the hydraulic pump;

at least one control valve fluidly connected to the pump via a pump line, the control valve being configured to control fluid flow between the pump and a second load circuit, wherein the first side of the first variable displacement pump/motor of the hydraulic transformer fluidly connects to the pump line at a point between the control valve and an outlet of the pump, wherein fluid flow can be provided via the pump line to both the second load circuit and the first variable displacement pump/motor simultaneously;

wherein the rotatable shaft includes a first portion that connects the first and second variable displacement pump/motor units and further includes a second portion that forms an output shaft that is adapted for mechanical connection to the external working load; and wherein the hydraulic system is incorporated into an excavator having an upper structure that pivots about a pivot axis relative to an undercarriage, and wherein the output shaft of the rotatable shaft is used to pivot the upper structure about the pivot axis, wherein the hydraulic transformer can transfer energy corresponding to a deceleration of the external load to the accumulator, and wherein the hydraulic transformer can also transfer energy corresponding to a deceleration of the external load to the second load circuit.

2. The hydraulic system of claim 1, wherein each of the first and second variable displacement pump/motor units includes a rotating group mounted on the rotatable shaft and a swash plate.

3. The hydraulic system of claim 1, further comprising a clutch for engaging the rotatable shaft with the external working load and for disengaging the rotatable shaft from the external working load.

4. The hydraulic system of claim 1, wherein the upper structure carries an excavation boom that is raised and lowered by a boom cylinder.

5. The hydraulic system of claim 4, wherein the first side of the first pump/motor unit is placed in fluid communication with an output port of the boom cylinder when the excavation boom is being lowered by the boom cylinder.

6. The hydraulic system of claim 5, further comprising a valve movable between a first position where the first side of the first pump/motor unit is fluidly connected to the pump and a second position where the first side of the first pump/motor unit is fluidly connected to the output port of the boom cylinder.

7. The hydraulic system of claim 4, wherein the hydraulic transformer includes a third pump/motor unit mounted on the rotatable shaft, wherein the third pump/motor unit includes a first side and a second side, wherein the second side of the third pump/motor unit fluidly connects to the tank, and wherein the first side of the third pump/motor unit is placed in fluid communication with an output port of the boom cylinder when the boom is being lowered by the boom cylinder.

8. The hydraulic system of claim 1, further comprising a hydraulic cylinder for raising and lowering a work item, the hydraulic cylinder being fluidly connected to the pump, the first side of the first pump/motor unit being placed in fluid communication with an output port of the hydraulic cylinder when the work item is being lowered by the hydraulic cylinder.

9. The hydraulic system of claim 8, wherein the work item is a boom.

10. The hydraulic system of claim 1, wherein the hydraulic transformer includes a third pump/motor unit mounted on the rotatable shaft, wherein the third pump/motor unit includes a first side and a second side, and wherein the second side of the third pump/motor unit fluidly connects to the tank.

11. The hydraulic system of claim 10, further comprising a hydraulic cylinder for raising and lowering a work item, wherein the first side of the third pump/motor unit is placed in fluid communication with an output port of the hydraulic cylinder when the work item is being lowered by the hydraulic cylinder.

12. The hydraulic system of claim 11, wherein the work item is a boom.

13. The hydraulic system of claim 1, wherein the hydraulic transformer is adapted to provide a motoring function wherein the rotatable shaft drives the external working load.

14. The hydraulic system of claim 1, wherein the hydraulic transformer is adapted to provide a pumping function wherein the rotatable shaft is driven by the external working load.

15. The hydraulic system of claim 1, wherein the rotatable shaft is adapted for mechanical connection to the external working load via a gear reduction.

16. The hydraulic system of claim 1, wherein the hydraulic transformer is adapted to level hydraulic system loads on a prime mover by:

a) transferring hydraulic energy to the accumulator and simultaneously mechanically transferring torque to the external working load when the hydraulic system load on the prime mover is lower than a target and when a command is received to drive the external working load;

b) transferring hydraulic energy to the accumulator and substantially not mechanically transferring torque to or from the external working load when the hydraulic system load on the prime mover is lower than the target and when no command is received to drive or brake the external working load;

c) transferring hydraulic energy to the accumulator and mechanically transferring torque from the external working load when the hydraulic system load on the prime mover is lower than the target and when a command is received to brake the external working load;

d) transferring substantially no hydraulic energy to the accumulator and mechanically transferring torque to the external working load when the hydraulic system load on the prime mover is at the target and when a command is received to drive the external working load;

e) transferring hydraulic energy to the accumulator and mechanically transferring torque from the external working load when the hydraulic system load on the prime mover is at the target and when a command is received to brake the external working load;

f) transferring hydraulic energy from the accumulator and mechanically transferring torque to the external working load when the hydraulic system load on the prime mover is higher than the target and when a command is received to drive the external working load;

g) transferring hydraulic energy from the accumulator and substantially not mechanically transferring torque to or from the external working load when the hydraulic system load on the prime mover is higher than the target and when no command is received to drive or brake the external working load; and h) transferring hydraulic energy from the accumulator and simultaneously mechanically transferring torque from the external working load when the hydraulic system load on the prime mover is higher than the target and when a command is received to brake the external working load.

17. The hydraulic system of claim 1, further comprising a negative flow control circuit having a negative flow control orifice valve, the negative flow control circuit allows a negative flow control pump control strategy to be used to control a displacement of the pump.

18. A system comprising:

a prime mover;

a hydraulic pump powered by the prime mover;

at least one control valve fluidly connected to the hydraulic pump via a pump line;

first and second load circuits powered at substantially pump outlet pressure by the hydraulic pump, the first load circuit including a hydraulic transformer having an output shaft adapted for mechanical connection to an external working load, the hydraulic transformer being fluidly connected to a hydraulic pressure accumulator, the hydraulic transformer providing a plurality of operations including:

a) a first operation in which the hydraulic transformer receives energy corresponding to a deceleration of the external working load from the output shaft and uses the energy to charge the hydraulic pressure accumulator;

b) a second operation in which the hydraulic transformer uses energy from the hydraulic pressure accumulator to transfer torque to the external working load through the output shaft;

c) a third operation in which the hydraulic transformer directs energy from the hydraulic pressure accumulator back toward the hydraulic pump for use at the second load circuit; and d) a fourth operation in which the hydraulic transformer directs energy from the hydraulic pump to the output shaft which transfers the energy to the external working load as torque;

wherein the control valve is configured to control fluid flow between the pump and the second load circuit, and wherein the hydraulic transformer fluidly connects to the pump line at a point between the control line and the pump, and wherein fluid flow can be provided via the pump line to both the second load circuit and the hydraulic transformer simultaneously, wherein the hydraulic system is incorporated into an excavator having an upper structure that pivots about a pivot axis relative to an undercarriage, wherein the output shaft of the hydraulic transformer is used to pivot the upper structure about the pivot axis.

19. The system of claim 18, wherein the hydraulic transformer also provides an operation of using energy from the hydraulic pump to charge the hydraulic pressure accumulator.

20. The system of claim 18, wherein the hydraulic transformer also provides an operation of transferring energy corresponding to a deceleration of the external working load from the output shaft back toward the hydraulic pump for use at the second load circuit.

21. The system of claim 18, further comprising an additional operation in which the hydraulic transformer transfers hydraulic energy to the accumulator and simultaneously mechanically transfers torque to the external working load when a command is received to drive the external working load.

22. The system of claim 18, further comprising an additional operation in which the hydraulic transformer transfers hydraulic energy from the accumulator and simultaneously mechanically transfers torque from the external working load when a command is received to brake the external working load.

23. A hydraulic system comprising:

an accumulator; and a hydraulic transformer including first and second variable displacement pump/motor units connected to a rotatable shaft, the rotatable shaft adapted for mechanical connection to an external working load, the first variable displacement pump/motor unit including a first side that fluidly connects to a pump and a second side that fluidly connects to a tank, the second variable displacement pump/motor unit including a first side that fluidly connects to the accumulator and a second side that fluidly connects with the tank;

wherein the rotatable shaft includes a first portion that connects the first and second variable displacement pump/motor units and further includes a second portion that forms an output shaft that is adapted for mechanical connection to the external working load; and wherein the hydraulic system is incorporated into an excavator having an upper structure that pivots about a pivot axis relative to an undercarriage, and wherein the output shaft of the rotatable shaft is used to pivot the upper structure about the pivot axis, wherein the hydraulic transformer is part of a first load circuit powered at substantially pump outlet pressure by the hydraulic pump, wherein the hydraulic system includes a second load circuit powered by the hydraulic pump, wherein the hydraulic transformer can transfer energy corresponding to a deceleration of the external load to the accumulator, and wherein the hydraulic transformer can also transfer energy corresponding to a deceleration of the external load to the second load circuit;

wherein the hydraulic transformer is adapted to level hydraulic system loads on a prime mover by:

a) transferring hydraulic energy to the accumulator and simultaneously mechanically transferring torque to the external working load when the hydraulic system load on the prime mover is lower than a target and when a command is received to drive the external working load;

b) transferring hydraulic energy to the accumulator and substantially not mechanically transferring torque to or from the external working load when the hydraulic system load on the prime mover is lower than the target and when no command is received to drive or brake the external working load;

c) transferring hydraulic energy to the accumulator and mechanically transferring torque from the external working load when the hydraulic system load on the prime mover is lower than the target and when a command is received to brake the external working load;

d) transferring substantially no hydraulic energy to the accumulator and mechanically transferring torque to the external working load when the hydraulic system load on the prime mover is at the target and when a command is received to drive the external working load;

e) transferring hydraulic energy to the accumulator and mechanically transferring torque from the external working load when the hydraulic system load on the prime mover is at the target and when a command is received to brake the external working load;

f) transferring hydraulic energy from the accumulator and mechanically transferring torque to the external working load when the hydraulic system load on the prime mover is higher than the target and when a command is received to drive the external working load;

g) transferring hydraulic energy from the accumulator and substantially not mechanically transferring torque to or from the external working load when the hydraulic system load on the prime mover is higher than the target and when no command is received to drive or brake the external working load; and h) transferring hydraulic energy from the accumulator and simultaneously mechanically transferring torque from the external working load when the hydraulic system load on the prime mover is higher than the target and when a command is received to brake the external working load.

* * * * *